US008820551B2

(12) United States Patent
Arney

(10) Patent No.: US 8,820,551 B2
(45) Date of Patent: Sep. 2, 2014

(54) EXPANDABLE FLUID PRESERVATION SYSTEM AND METHOD FOR USE

(75) Inventor: Michelle Arney, San Francisco, CA (US)

(73) Assignee: Smart Assets, Inc., San Francisco, CA (US)

( * ) Notice: Subject to any disclaimer, the term of this patent is extended or adjusted under 35 U.S.C. 154(b) by 688 days.

(21) Appl. No.: 12/949,003

(22) Filed: Nov. 18, 2010

(65) Prior Publication Data

US 2012/0125930 A1 May 24, 2012

(51) Int. Cl.
*B65D 39/12* (2006.01)
*B65D 81/24* (2006.01)

(52) U.S. Cl.
CPC ..... *B65D 81/245* (2013.01)
USPC ..... 215/269; 220/720; 220/578; 220/232; 53/489

(58) Field of Classification Search
USPC ..... 220/231, 232, 720–723, 578–580; 215/269, 231; 53/488, 489, 403; 426/397; 446/486–489; 137/209
See application file for complete search history.

(56) References Cited

U.S. PATENT DOCUMENTS

| | | | | |
|---|---|---|---|---|
| 601,877 | A | 4/1898 | Lochmnn | |
| 3,343,701 | A | 9/1967 | Mahoney | |
| 4,392,578 | A * | 7/1983 | Fipp et al. | 215/231 |
| 4,482,072 | A * | 11/1984 | Hankins | 215/269 |
| 4,684,033 | A | 8/1987 | Marcus | |
| 6,220,311 | B1 | 4/2001 | Litto | |
| 8,365,758 | B2 * | 2/2013 | Maiocco | 137/209 |
| 2004/0081739 | A1 | 4/2004 | Sibley | |
| 2010/0108182 | A1 | 5/2010 | Noonan | |
| 2011/0278297 | A1 * | 11/2011 | Corti | 220/232 |

* cited by examiner

*Primary Examiner* — Anthony Stashick
*Assistant Examiner* — Raven Collins
(74) *Attorney, Agent, or Firm* — Michelle Arney

(57) ABSTRACT

A fluid preservation system for use with a container containing both fluid and gas where there exists a transition between the fluid and the gas and where the container has an opening with a first inside diameter and a first inner surface and a body with a second inside diameter and a second inner surface. The fluid preservation system comprises an elongated member with a proximal end and a distal end, an expandable sealing member near the distal end of the elongated member, where the expandable sealing member has an expanded state and a compressed state. Means to change the expanded sealing member between the expanded state and the compressed state is located near the proximal end of the elongated member. The expandable sealing member in the expanded state is in contract with the second inner surface of the container near the transition between the fluid and the gas. The expandable sealing member in the compressed state is able to pass through the first inside diameter of the opening of the container. The means to change the state of the expandable sealing member remains outside of the container and the expandable sealing member in the expanded state displaces less than substantially all of the gas in the container.

10 Claims, 23 Drawing Sheets

EXPANDABLE FLUID PRESERVATION SYSTEM AND METHOD FOR USE

FIELD OF THE INVENTION

The present invention relates to the preservation of fluid inside a container.

BACKGROUND

Containers used for the storage of fluids, such as beverages, are usually sealed to reduce spillage and contamination caused by exposure to outside air. Often a beverage is only partially consumed and resealed after opening. However, since the volume of fluid within the container has been reduced, potentially contaminating air is often sealed inside the container along with the fluid, causing contamination of the fluid.

For example, one may open a bottle of wine, consume only a portion of the wine, and reseal the wine bottle so that the remaining wine can be enjoyed at a later time. However the wine will only retain its flavor and quality for a few days in the resealed condition because air has entered the bottle to replace the consumed volume of wine and the air is in contact with the wine in the resealed condition. The air oxidizes the wine, which diminishes the flavor and quality of the wine.

A similar problem exists with other beverages, such as carbonated beverages, milk, or other beverages which are adversely affected by air or other gasses entering the container and coming in contact with the beverage.

A similar problem exists with other fluids, such as chemicals, either liquid or gaseous, which are affected by exposure to air or other gasses.

To counteract these problems, several approaches have been taken to minimize a fluid's contact with contaminating gases. Most of these approaches have taken place in the beverage field.

Vacuum sealers have been used to seal wine bottles in an attempt to remove as much air as possible from the wine bottle during the resealing process. These devices only pull a light vacuum, however, and do not remove all the air from the bottle. As a result, wine is still contaminated relatively quickly.

Nitrogen has been used to replace the air in wine bottles since nitrogen is less contaminating than air to wine. However, this approach is cumbersome and requires replacement pressurized nitrogen cartridges.

Patent application 2004/0081739 to Sibley describes the concept of pouring marbles, anatomically shaped or otherwise, into a wine bottle after it has been partially consumed to displace substantially all of the air in the bottle. However this approach does not allow the marbles to be removed easily from the bottle. The approach also would make pouring the remaining fluid from the bottle, after the marbles have been introduced, a very messy and cumbersome operation.

U.S. Pat. No. 6,220,311 to Litto describes a fluid preservation system that is an integral part of the fluid storing container itself and not a separate device which can be used with various or standard containers. The patent also describes, briefly, a wine preservation method of pouring conventional marbles into an opened wine bottle to displace substantially all of the air in the wine bottle. Like patent application 2004/0081739, above, this approach would make pouring the remaining fluid from the bottle, after the marbles have been introduced, a very messy and cumbersome operation. Removing the marbles before pouring the wine would also be messy and difficult.

U.S. Pat. No. 4,684,033 to Marucs, U.S. Pat. No. 3,343,701 to Mahoney, U.S. Pat. No. 601,877 to Lochmann and patent application 2010/0108182 to Noonan show variations of a balloon being used in a container to replace substantially all of the air, or to expel substantially all of the air from the container. The devices described however are bulky, cumbersome, messy, and do not allow for exact placement of the device at or near (above or below) the surface of the fluid.

Patent application 2010/0108182 also shows a flat circular structure which can be placed on the surface of a fluid. The devices described however do not allow for the insertion of the device through a narrow opening into a container which is larger than the diameter of the opening. The devices described also do not allow for exact placement of the device at, or near (above or below) the surface of the fluid.

There remains a need for a simple, effective, inexpensive and reusable device and method to preserve fluid inside a container which allows the fluid to be easily used after resealing the container and storing the container for some period of time.

SUMMARY

The present invention provides a solution which overcomes the shortcomings of prior devices and methods. The present invention provides a fluid preservation system and method, for preserving fluid in a container, which is simple, inexpensive, effective, reusable and which also allows for easy use of the unconsumed fluid after it has been stored. An expandable sealing member is at the distal end of an elongated member and the expandable sealing member can be in either an expanded or compressed state. The expandable sealing member in its contracted, collapsed or compressed state fits through the opening of the container and into the container. The expandable sealing member in its expanded state contacts, and seals, the inside of the body of the container. The expandable sealing member seals the fluid holding container inside the container near or at the surface of the partially consumed fluid. Sealing near or at the surface of the fluid significantly reduces the volume of contaminating gas to which the consumable fluid is exposed. The mechanism for changing the expandable sealing member from the compressed to its expanded state, or from the expanded to the compressed state, is at the proximal end of the elongated member, and remains outside of the container for easy access.

Traditionally, bottles and other fluid holding containers are sealed at the opening of the container after a portion of the fluid has been consumed. This traps a significant amount of contaminating gas or air in the container which then contaminates the unconsumed fluid over time. Sealing the container inside the container, near or at the fluid surface, reduces the exposure of the unconsumed fluid to the contaminating gas.

In one embodiment, the container may be a wine bottle and the fluid may be wine. In this case the expandable sealing member may be a hollow elastomeric bulb or ball. This bulb can be made small 100 enough to be introduced through the opening of the partially consumed wine bottle by either decreasing the pressure within the bulb (applying a vacuum to it) or twisting the bulb or elongating the bulb to reduce the cross sectional area of the bulb or any combination of these methods. After the wine is opened for the first time, and a portion of the wine in the wine bottle is consumed, the fluid preservation system bulb is introduced into the bottle and expanded so that it forms an air-tight seal 105 with the inside of the bottle near the surface of the unconsumed wine. As a result, the wine in the bottle is exposed to minimal or negligible air while it is being stored in anticipation of future consumption. In addition to using the fluid preservation system, the wine bottle may also be sealed at the top of the bottle, with a cork or otherwise, but this additional sealing may not be necessary since the bulb will prevent wine spillage in addition to preserving the wine.

The bulb may be expanded by removing the negative internal pressure from inside the bulb, applying positive internal pressure inside the bulb, compressing the bulb, twisting the bulb or any combination of these methods.

The bulb may be reduced for removal from the bottle by removing positive internal pressure from inside the bulb, applying negative internal pressure to the inside of the bulb, elongating the bulb, twisting the bulb or any combination of these methods.

In another embodiment of the fluid preservation system the expandable sealing member may 120 resemble an umbrella. The expandable sealing member is connected to an elongated member and is introduced into the container, or wine bottle, in the compressed state, again, much like an umbrella in the compressed state. Once the expandable sealing member is in the desired location (at or near (above or below) the surface of the fluid), the expandable sealing member is expanded in much the same way an umbrella is deployed. An inner shaft, sleeve or sheath is moved relative to an outer shaft, sleeve or sheath which forces the expandable sealing member open. The edge of the expandable sealing member may have a flexible material so that it seals tightly with the wall of the container. The covering of the expandable sealing member may be an air or gas impermeable material so that the fluid is protected from the outside air/gas. The expandable sealing member may be locked into place similarly to an umbrella. There may be more than one locking location so that the expandable sealing member may be expanded to, and locked into, different diameters, depending on the inside diameter of the container.

The tip of the expandable sealing member may include a stopper or floater end piece to help locate the surface of the fluid in the container.

In yet another embodiment of the fluid preservation system the umbrella type sealing mechanism may be inversed, so that the wider portion is distal and the narrower portion is proximal.

In yet another embodiment of the fluid preservation system the expandable sealing member is naturally in the open or expanded state. In this embodiment, the expandable sealing member is compressed by pulling it through an outer shaft, sheath or sleeve so that it can be inserted into a container with a narrow opening. The structure of the expanding sealing mechanism of this embodiment may take several different forms, including a spring, tines, coil, or other form or any combination of these forms.

In yet another embodiment of the fluid preservation system the expandable sealing member is made up of one or several gas or air impermeable sheaths which overlap. The sheath or sheaths can be compressed by pulling them into the outer shaft or sleeve or by twisting or rotating the expandable sealing member so that the expandable sealing member can be inserted into a container with a small opening.

In yet another embodiment of the fluid preservation system the expandable sealing member is made up of flexible braces which can be compressed or expanded by moving the inner shaft with respect to the outer shaft. The flexible braces may be part of the outer shaft and created by slicing the outer shaft longitudinally. The flexible braces may take a curved shape, an angled shape, or a combination when they are expanded. This embodiment also has a coating or sheath covering the expanding sealing portion which is impermeable to gas or air to protect the fluid in the container.

The fluid may be any liquid or gas and may even be a consumable solid-like material such as honey, jelly, flour or tar. The fluid may be a food or beverage or may be an industrial material such as acid, paint or a cleaning solution or other material. The container may be any container, either rigid or flexible, but is preferably rigid.

DETAILED DESCRIPTION

Figure 1A:
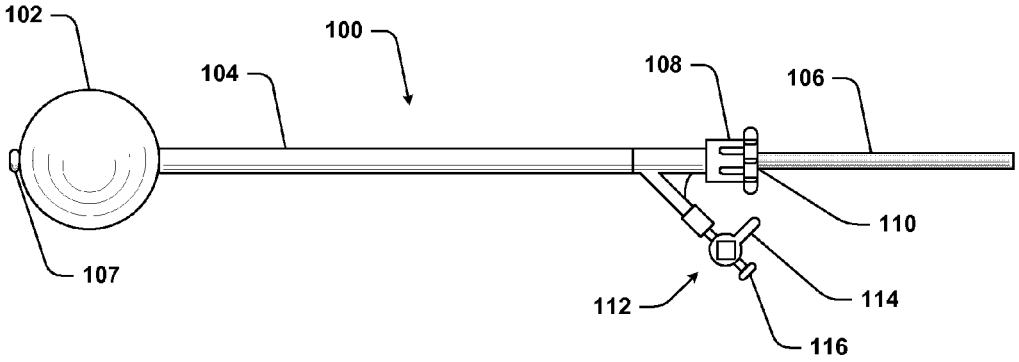
FIGS. 1A-1E are views of an embodiment of the fluid preservation system in various stages of use.

FIG. 1A shows a fluid preservation system 100. At the distal end of the fluid preservation system is bulb 102. The bulb is preferably hollow and made from an elastomeric material such as silicone, rubber, or any other suitable material. The material is preferably relatively inert so that it will not contaminate the fluid if it comes in contact with the fluid. The bulb may be spherical, elliptical or other shape. The bulb may also be a ball, a balloon, an inflatable member or other deformable shape.

An elongated member comprises outer shaft 104 and inner shaft 106. Outer shaft 104 is attached to bulb 102, preferably at the distal end of the outer shaft, and the proximal end of the bulb. The attachment between outer shaft 104 and bulb 102 may be a fluid-tight seal. The outer shaft is preferably hollow and may be made from metal, plastic, or any other suitable material. The material of the outer shaft is preferably relatively inert so that it will not contaminate the fluid if it comes in contact with the fluid. The outer shaft is preferably rigid or semi-rigid, but may also be flexible.

Inner shaft 106 is attached to bulb 102, preferably at the distal end of the inner shaft, and the distal end of the bulb Inner shaft 106 may be hollow or solid and may be made from metal, plastic, or any other suitable material. The inner shaft is preferably rigid or semi-rigid, but may also be flexible. The outer diameter of inner shaft 106 is smaller than the inner diameter of outer shaft 104 so that the inner shaft fits inside the outer shaft. Preferably, there is enough space between the inner shaft and the outer shaft so that they can move relative to each other in both the longitudinal and rotational directions. Preferably there is also enough space between the two shafts to allow some air to flow between them in the lumen between the outside of inner shaft 106 and the inside of outer shaft 104. This lumen is in fluid communication with bulb 102.

End piece 107 may or may not be present. The end piece may help the inner shaft attach to the bulb, or it may serve as a float to help identify when the bulb is touching the surface of a fluid it is meant to preserve. The end piece may be made out of any suitable material including silicone or plastic and may be hollow to facilitate floating.

Valve 108 controls both the ability of inner shaft 106 to move relative to outer shaft 104 as well as the airtight seal around inner shaft 106. When valve 108 is in a tightly closed state, the inner shaft cannot move relative to the outer shaft and air cannot escape or enter through valve opening 110. When valve 108 is in an open state, inner shaft 106 can move both longitudinally and rotationally 215 relative to outer shaft 104 and air can escape or enter through valve opening 110. When valve 108 is in an intermediate state, the inner and outer shaft can move relative to each other, either longitudinally or rotationally, but air cannot escape or enter through valve opening 110.

Port 112 controls the air, or other fluid, which may be introduced or removed in the lumen 220 between the outside of inner shaft 106 and the inside of outer shaft 104. The port inlet 116 may be connected to a pressure/vacuum device and the port control 114 controls the fluid flow. The port control may be in the open or closed position. In FIG. 1A, the port control is shown in the open position.

Figure 1B:
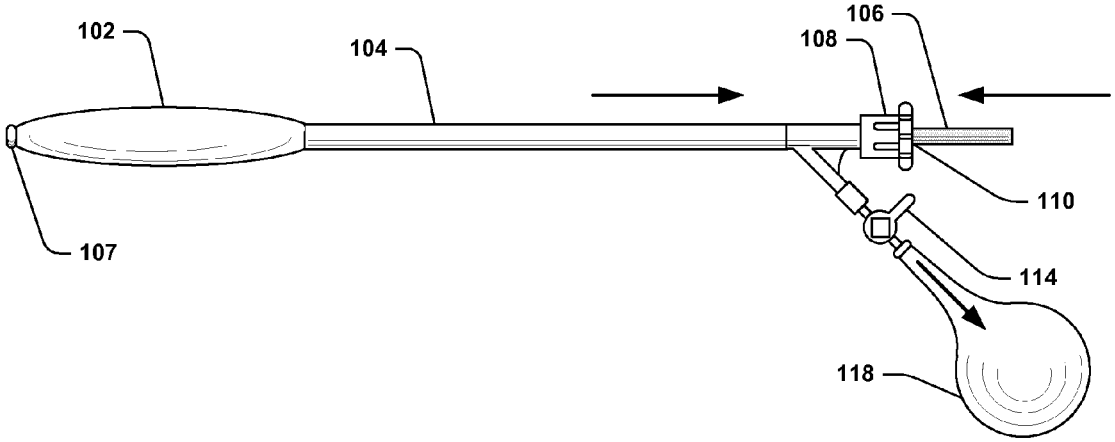

FIG. 1B shows the fluid preservation system with bulb 102 in an elongated position. This position is achieved by moving inner shaft 106 with respect to outer shaft 104 in the longitudinal directions as the arrows indicate. A vacuum may also be applied to bulb 102 to further reduce the diameter of the bulb. Pressure/vacuum device 118 may be used to pull a vacuum.

Figure 1C:
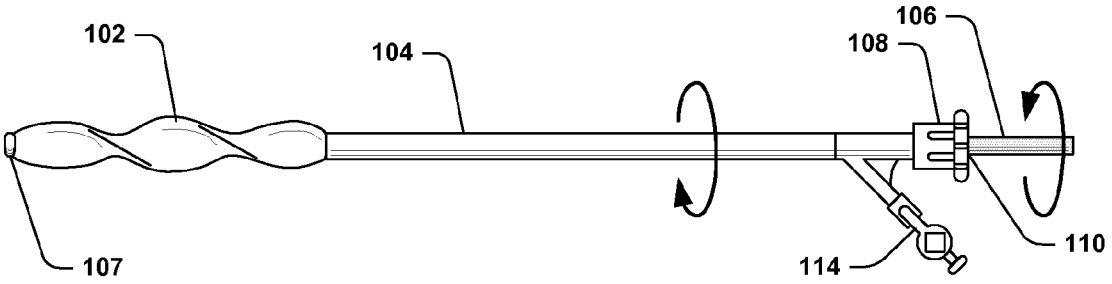

FIG. 1C shows the fluid preservation system with bulb 102 in an elongated and twisted position. This position is achieved by moving inner shaft 106 with respect to outer shaft 104 in the rotational directions as the arrows indicate. A vacuum may also be applied to bulb 102 to further reduce the diameter of the bulb. In FIG. 1C port control 114 is in the closed position to hold a vacuum within bulb 102 so that a small diameter of the bulb can be maintained.

Figure 1D:
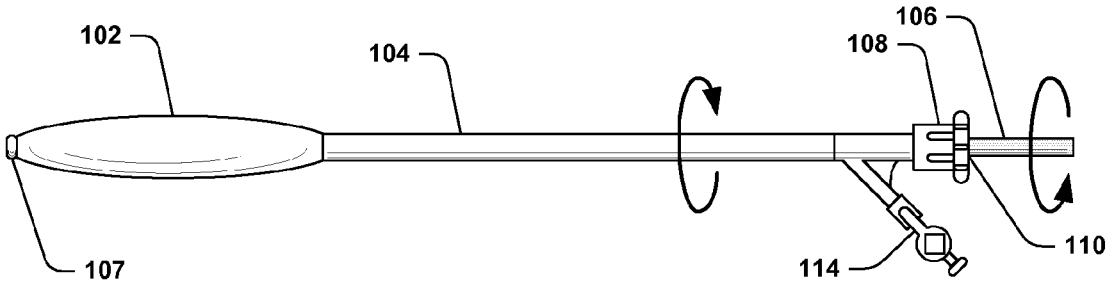

FIG. 1D shows the fluid preservation system with bulb 102 returned to the untwisted, elongated position. This position is obtained by rotating inner shaft 106 with respect to outer shaft 104 in the opposite direction as that in FIG. 1C.

Figure 1E:
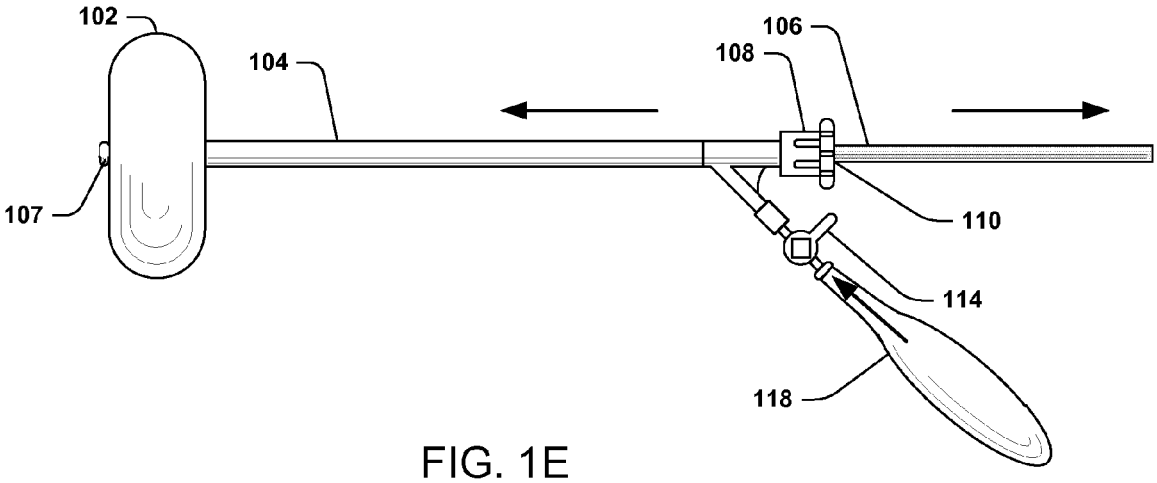

FIG. 1E shows the fluid preservation system with bulb 102 in the expanded position. This position is achieved by moving inner shaft 106 with respect to outer shaft 104 in the longitudinal directions as the arrows indicate. Air pressure may also be applied to bulb 102 to further increase the diameter of the bulb. Pressure/vacuum device 118 may be used to apply pressure.

Figure 2A:
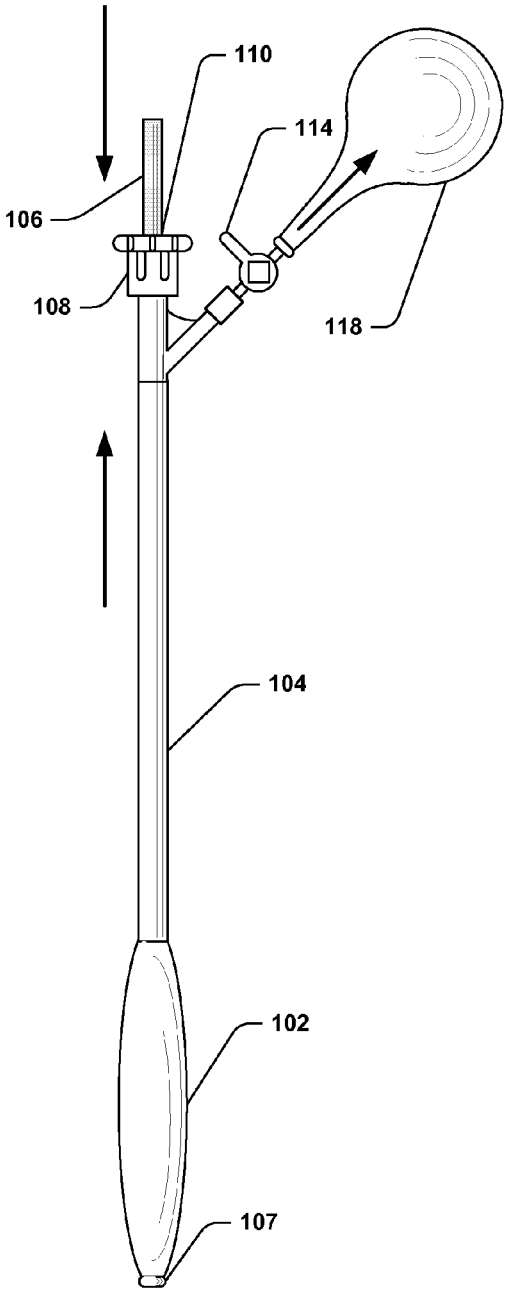
FIGS. 2A-2G show an embodiment of the fluid preservation system in use in a wine bottle.
Figure 2B:
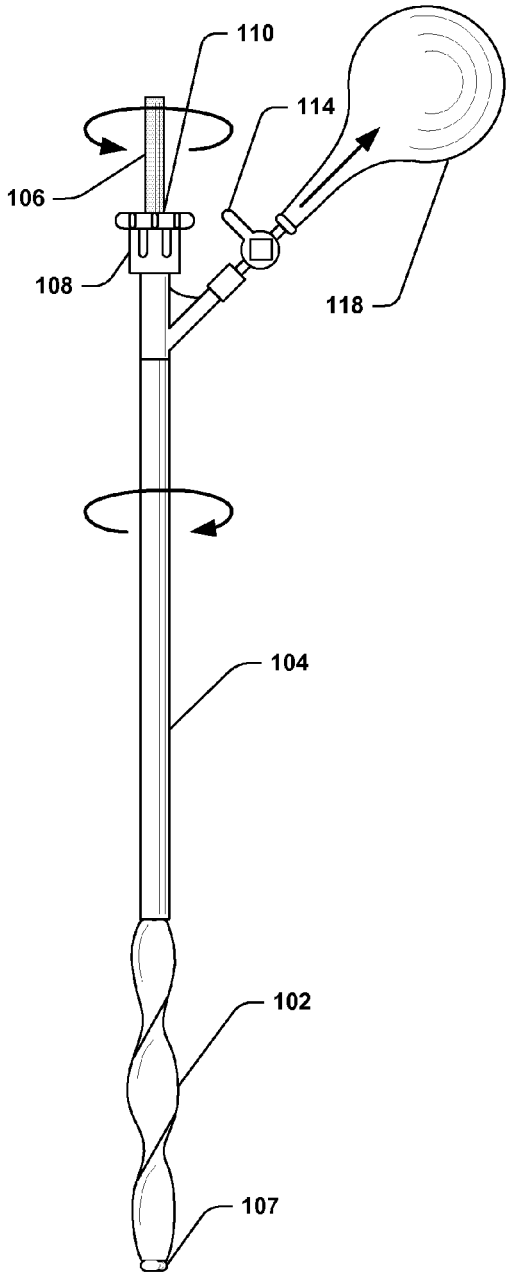

FIGS. 2A-2H show the steps taken to use the fluid preservation system to preserve wine in a wine bottle. FIG. 2A shows the fluid preservation system with the bulb in the elongated position. FIG. 2B shows the system with the bulb in the elongated and twisted position which further reduces the diameter of the bulb in the elongated position. To insert the fluid preservation into the small opening of a wine bottle, it may be necessary to place the system with the bulb in the elongated and twisted 250 position so that the bulb is small enough to enter the bottle. Larger bottles or containers may not require the twisting step to reduce the diameter of the bulb. Similarly, if the size and thickness of the bulb are small enough, the twisting step may not be necessary to reduce the bulb diameter enough to enter a wine bottle or other container.

Figure 2C:
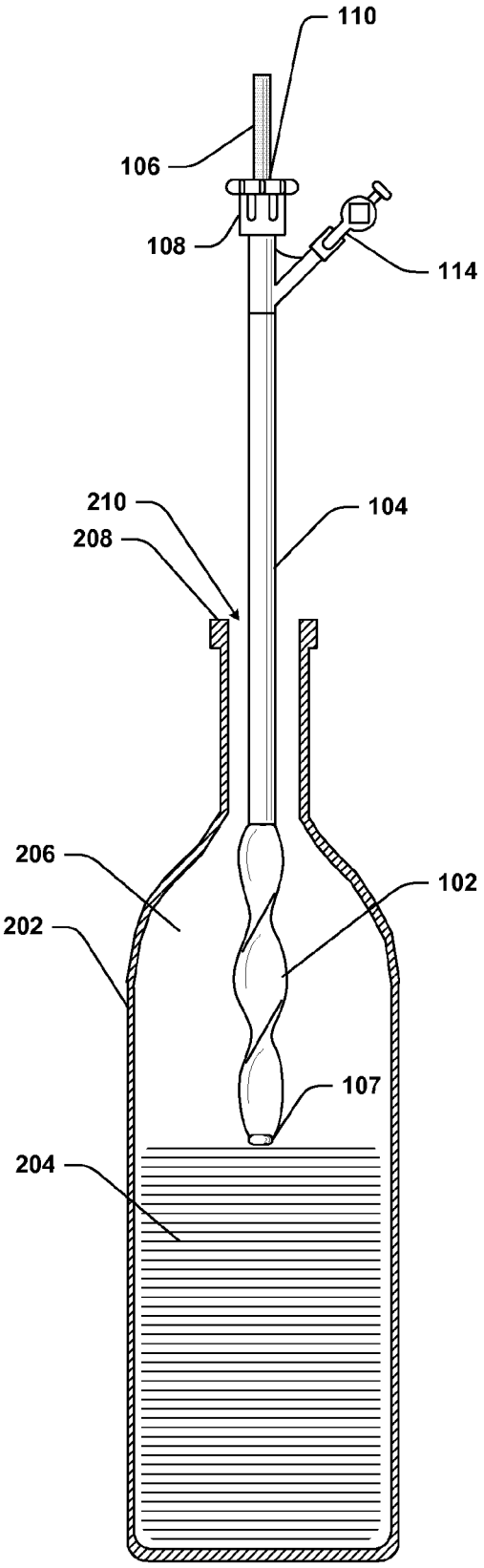
Figure 2D:
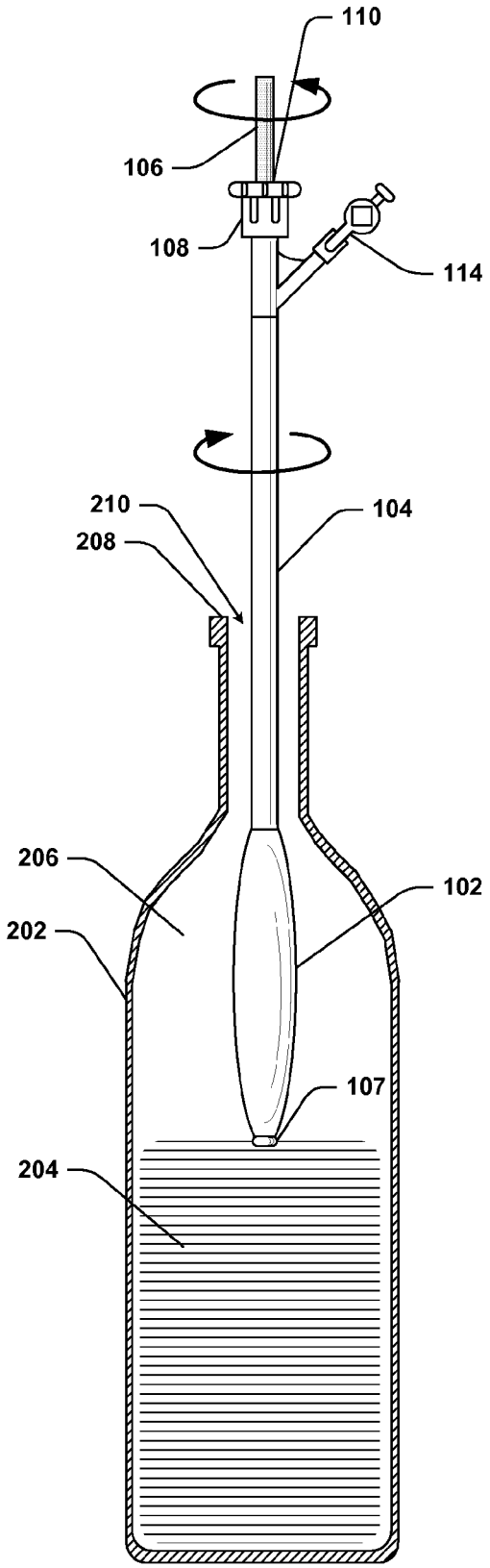

FIG. 2C shows the fluid preservation system inserted into a partially consumed bottle of wine. Wine bottle 202 contains both wine 204 and air 206. Top 208 of the wine bottle surrounds opening 210. If the fluid preservation system bulb has been twisted to reduce the diameter of the bulb so that it is small enough to enter the bottle opening, then the bulb is untwisted in the next step, as depicted in FIG. 2D. Preferably, in its smallest state, either elongated, twisted or both, the bulb diameter is less than about 20 mm so that it will fit into the wine bottle opening. In other words, the outside diameter of the expandable sealing member in the compressed or collapsed state is smaller than the inside diameter of the opening of the container. End piece 107 may serve as a float or bumper so that it is easier to tell when the bulb is at the surface of the wine.

Figure 2E:
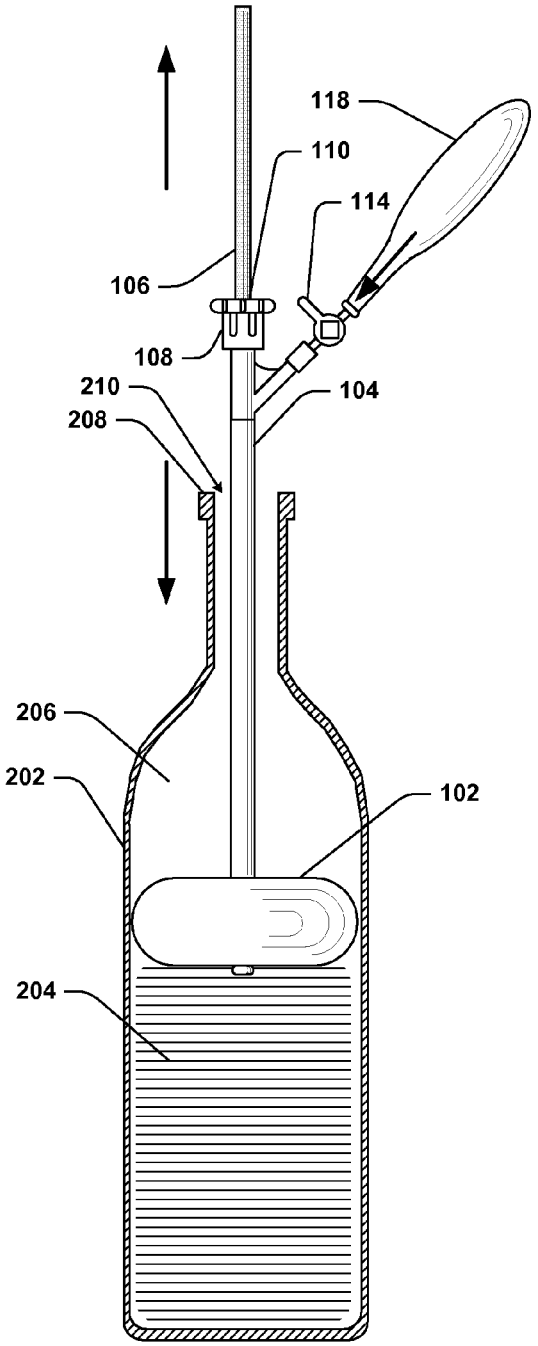

FIG. 2E shows the fluid preservation system in place after bulb 102 has been expanded to protect the wine from excessive exposure to contaminating air. The wine can be stored with the fluid preservation system in this state. Expanded bulb 102 forms an air-tight seal with the internal surface of bottle 202. Bulb 102 is expanded as close to the surface of wine 204 as is necessary to prevent or retard wine spoilage. Preferably, in its expanded state, the expandable sealing member is less than about 100 mm. Note that in this state, the wine is exposed to very little, if any air. Also note that although an addition cork or seal may be used to close opening 210, or to stabilize the fluid preservation system within the bottle, this may not be necessary since the airtight seal between bulb 102 and wine 204 prevents wine spillage and spoilage.

Figure 2F:
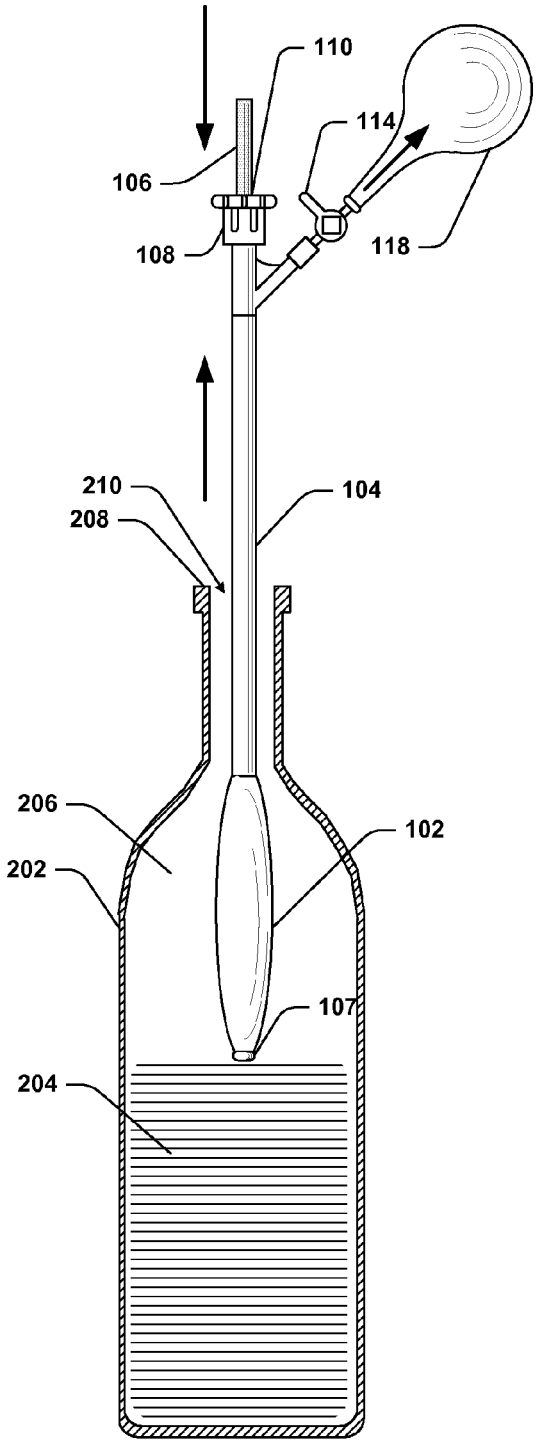
Figure 2G:
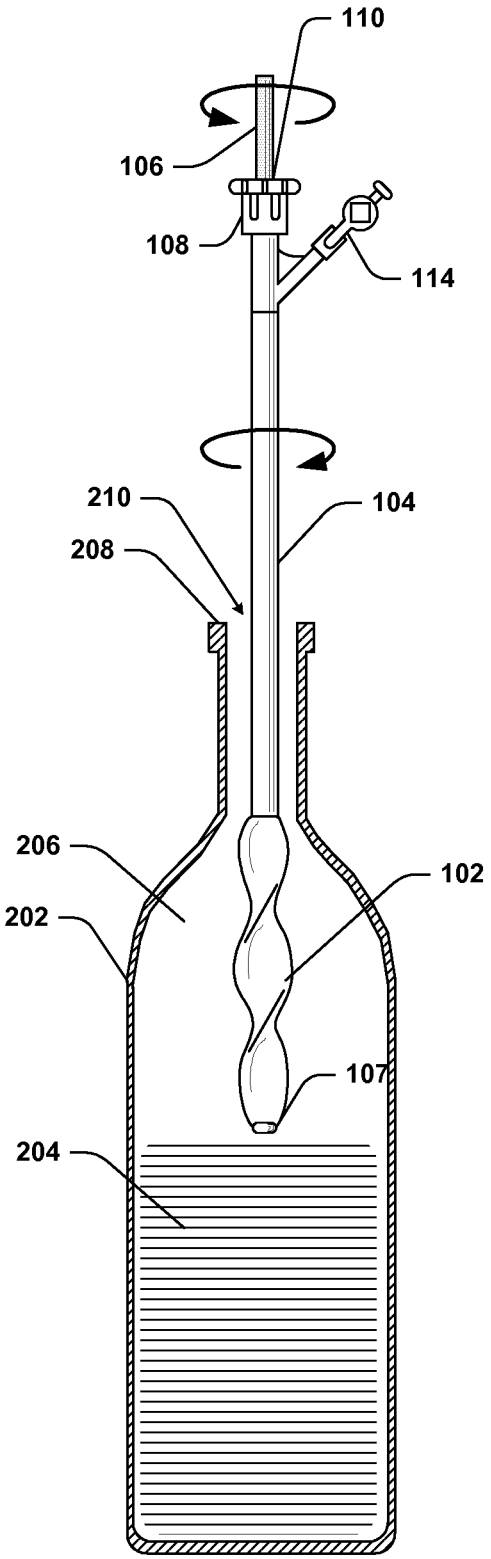

After the unconsumed wine has been stored and the wine is to be consumed, the fluid preservation system is removed by first reducing the diameter of bulb 102 by elongating the bulb, and possibly twisting the bulb as is depicted in FIGS. 2F and 2G. The fluid preservation system is then removed, and the wine is consumed. This process can be repeated for further storage if all the wine is not consumed at the next sitting.

FIGS. 3A-3F show one embodiment of valve 108 in combination with port 112. The valve comprises valve base 302, valve cap 304 and o-ring 306. The o-ring is shown in a relaxed state in FIG. 3A. Both valve base 302 and valve cap 304 have threads 308 so that the valve cap can be advanced within the valve base by rotating the cap with respect to the base. The inner dimensions of valve base 302, valve cap 304 and o-ring 306 in the relaxed position are greater than the outer dimension of inner shaft 106 so that the inner shaft fits through the valve. Valve base 302 is attached to, or integral with, outer shaft 104. Lumen 310 is the space between the inside of the outer shaft and the outside of the inner shaft and can be used to apply or reduce pressure to the bulb (not shown) at the distal end of the fluid preservation system.

In this embodiment, valve base 302 and valve cap 304 may be made out of a hard plastic, such as polycarbonate or polyethylene, or metal or other suitable material. The material for the valve base and cap is preferably a rigid material. O-ring 306 may be made out of any suitable elastomeric material such as silicone, rubber, or any other material. Port 112 and port control 114 may be made out of any suitable material such as plastic, such as polycarbonate or polyethylene, or metal or other suitable material.

Figure 3A:
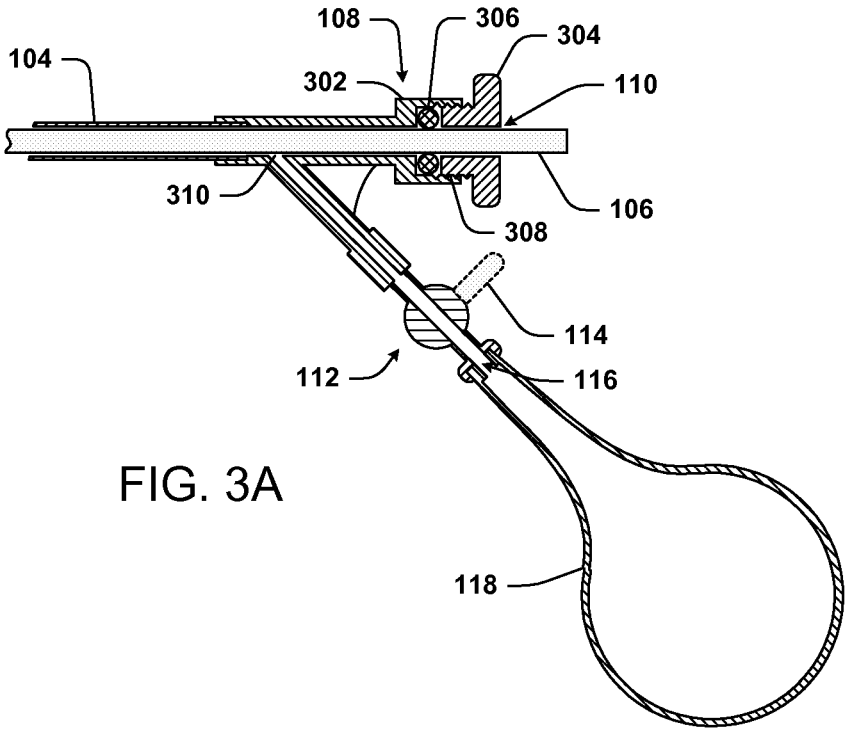
FIGS. 3A-3F show an embodiment of the valve of an embodiment of the fluid preservation system.

FIG. 3A shows the valve in an open state and the port control in the open position. In this position air can flow through valve opening 110 and inner shaft 106 can move longitudinally and rotationally within outer shaft 104 and air can flow through port inlet 116.

Figure 3B:
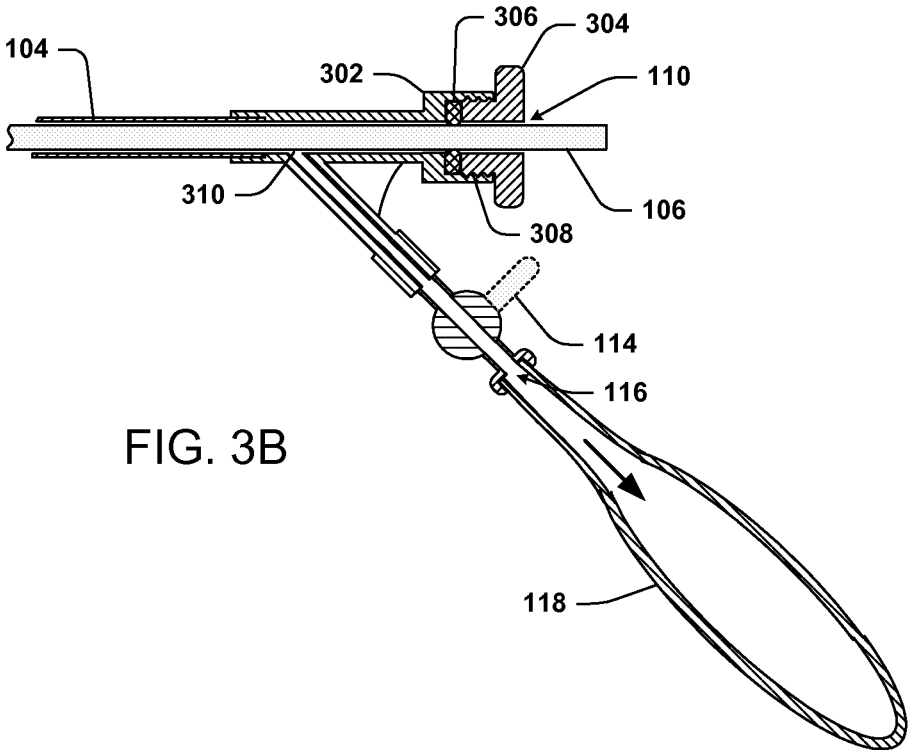

FIG. 3B shows the valve in an intermediate or tightly closed state. A non-open state is achieved by rotating valve cap 304 within valve base 302 to compress o-ring 306. As the o-ring is compressed, it presses up against the outside surface of inner shaft 106. As the o-ring is compressed, and presses up against the outside surface of the inner shaft, air is prevented from passing through valve opening 110, but inner shaft 106 is still able to move with respect to outer shaft 104. This is called the intermediate state of the valve. As the o-ring is compressed further, the seal between the o-ring and the inner shaft becomes stronger and not only is air prevented from passing through the valve opening, but movement of the inner shaft with respect to the outer shaft is prevented. This is called the tightly closed state of the valve. In this way, one can control both the movement of the inner and outer shaft with respect to each other and the air passage through the valve opening with a simple rotation of the valve cap.

FIG. 3B also shows pressure/vacuum device 118 pulling a vacuum on the bulb (not shown) by pulling air out of port inlet 116 as port control 114 is in the open position.

Figure 3C:
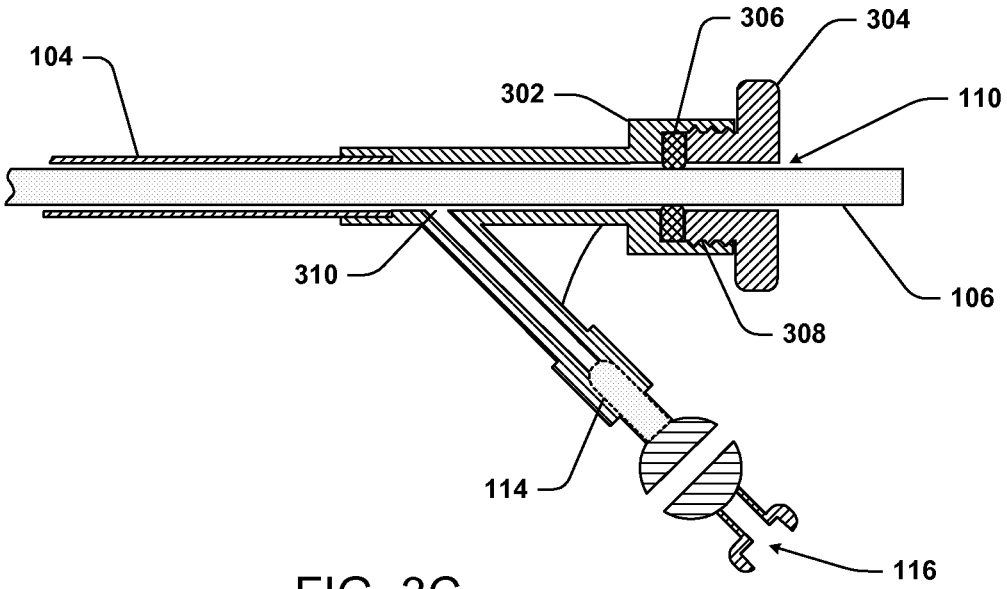

FIG. 3C shows the valve in an intermediate or tightly closed state where port control 114 is in the closed position. In this configuration, air cannot enter or exit the bulb (not shown).

Figure 3D:
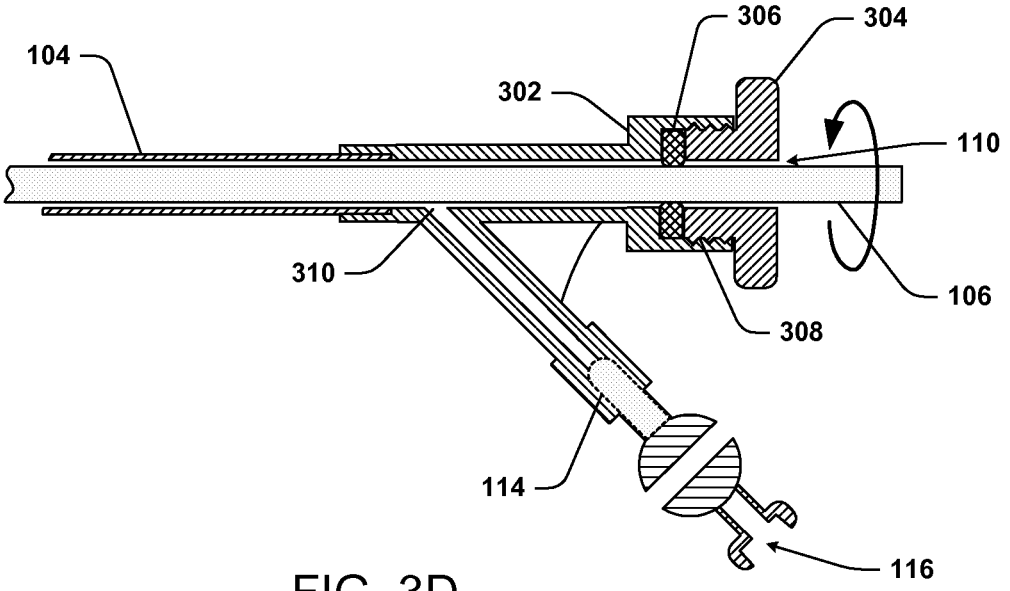

FIG. 3D shows the valve in an intermediate state. In this state, inner shaft 110 can move rotationally with respect to outer shaft 104, but air cannot enter or exit the bulb (not shown).

Figure 3E:
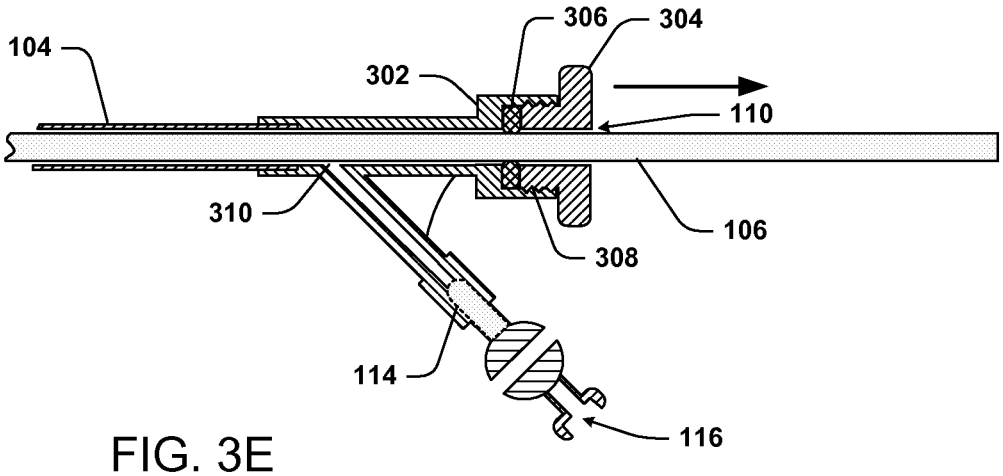

FIG. 3E shows the valve in an intermediate state. In this state, inner shaft 110 can move rotationally with respect to outer shaft 104, but air cannot enter or exit the bulb (not shown).

Figure 3F:
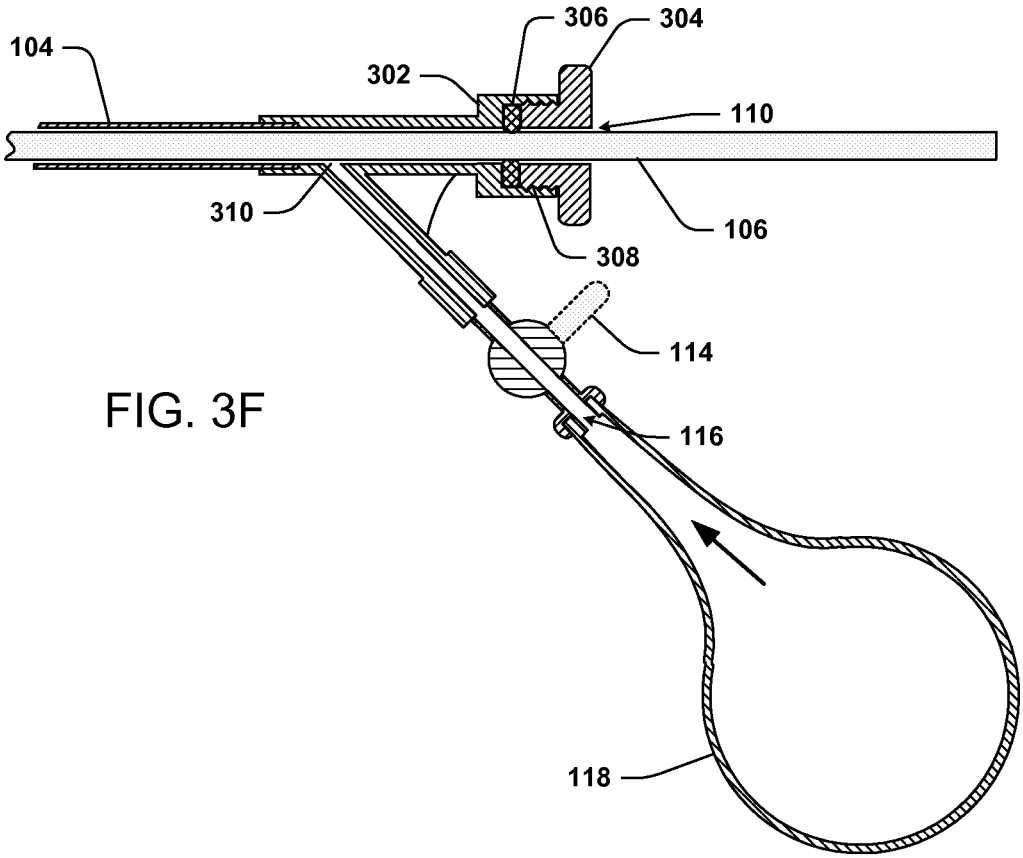

FIG. 3F shows the valve in an intermediate or tightly closed state where port control 114 is in the open position. Pressure/vacuum device 118 is inserting air into the bulb (not shown) which pressurizes the bulb.

It is understood that although one embodiment of the valve and port has been shown here, many other embodiments are possible. For example, rather than having a separate, detachable pressure/vacuum device, the entire valve, port and pressure/vacuum device may be incorporated into one device. The various steps of opening and closing the valve, moving the shafts with respect to each other, and pressurizing and depressurizing the bulb may be automated or happen simultaneously as necessary. For example, the user may only need to push one button to ready the fluid preservation system for inserting into the container, then one button to deploy the fluid preservation system for storage, then one button to un-deploy the fluid preservation system for removal from the container.

The valve, port and pressure/vacuum device combination may also be much more compact or large or shaped differently than what is shown in the drawings here.

Figure 4A:
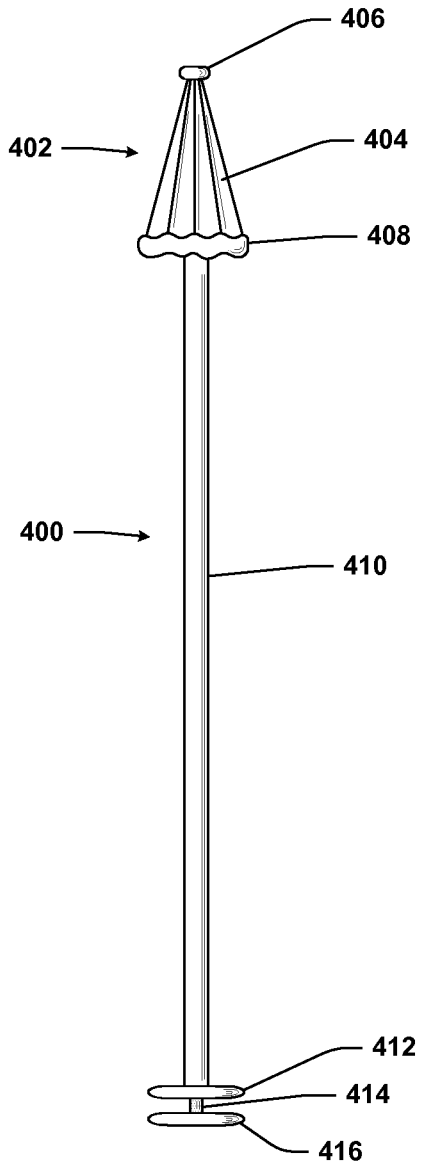
FIGS. 4A-4B show another embodiment of the fluid preservation system.

FIG. 4A shows another embodiment of a fluid preservation system 400 in the collapsed position. This embodiment functions similarly to an umbrella. Expandable sealing member 402 is at the distal end of an elongated member. End piece 406 may or may not be present. The end piece may serve as a float to help identify when the bulb is touching the surface of a fluid it is meant to preserve. The end piece may be made out of any suitable material including silicone or plastic and may be hollow to facilitate floating. Flexible sheath 404 is on a framework and can collapse or expand and serves as the primary barrier between the fluid which is being preserved, and the contaminating air or gas in the container. The flexible sheath may be made out of any flexible and relatively impenetrable material such as silicone, rubber, nylon, polyethylene, or any other polymer or any other suitable material. The material of the flexible sheath may or may not be elastomaric. The flexible sheath is preferably relatively thin so that it can be easily collapsed to fit through the opening of a container. The framework is preferably rigid and made out of metal, plastic, or any suitable material. All materials which come in contact with the fluid are preferably relatively inert so that they will not contaminate the fluid.

Sealing edge 408 runs around the outer circumference of expandable sealing member 402. The sealing edge is preferably made out of a flexible, malleable or elastomeric material, such as silicone, rubber, plastic or any other suitable material. The sealing edge seals against the inner wall of the container when the expandable sealing member 402 is in the expanded position.

Outer shaft 410 is attached to expandable sealing member 402. The outer shaft is preferably hollow and may be made from metal, plastic, or any other suitable material. The material of the outer shaft is preferably relatively inert so that it will not contaminate the fluid if it comes in contact with the fluid. The outer shaft is preferably rigid or semi-rigid.

Inner shaft 414 is attached to expandable sealing member 402. Inner shaft 414 may be hollow or solid and may be made from metal, plastic, or any other suitable material. The inner shaft is preferably rigid or semi-rigid. The outer diameter of inner shaft 414 is smaller than the inner diameter of outer shaft 410 so that the inner shaft fits inside the outer shaft. Preferably, there is enough space between the inner shaft and the outer shaft so that they can move relative to each other. Outer handle 412 and inner handle 416 serve as grips so that the inner shaft and the outer shaft can be moved relative to each other.

Figure 4B:
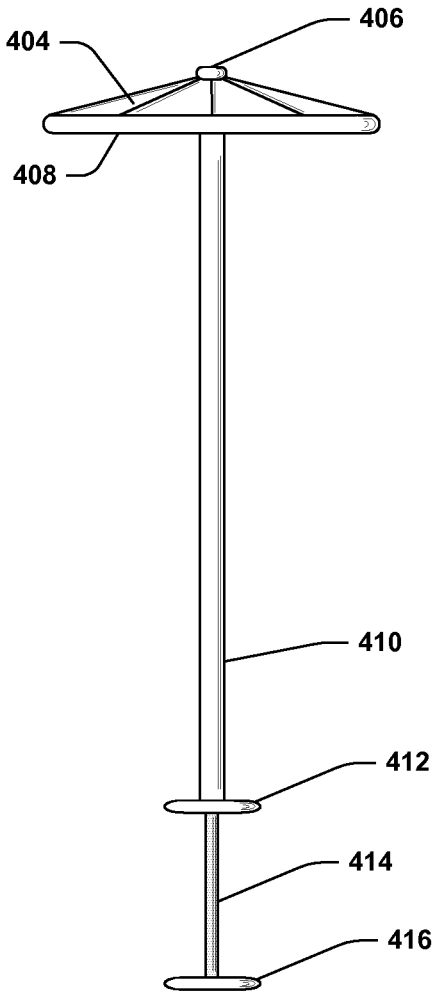

FIG. 4B shows this embodiment of a fluid preservation system in the expanded position. Note that inner shaft 414 and outer shaft 410 have been moved with respect to each other to expand the framework underlying flexible sheath 404. Sealing edge 408 is expanded so that it can contact the interior of a container and seal the fluid in the container from contaminating air. The inner shaft and outer shaft may be moved with respect to each other manually, or with an automatic mechanism. The mechanism may be ratcheted to accommodate different sized containers. The expandable sealing member may be locked in this position. The locking mechanism (not shown) may have a release mechanism, which may be a quick-release mechanism for removing the fluid preservation system from the container.

Figure 4C:
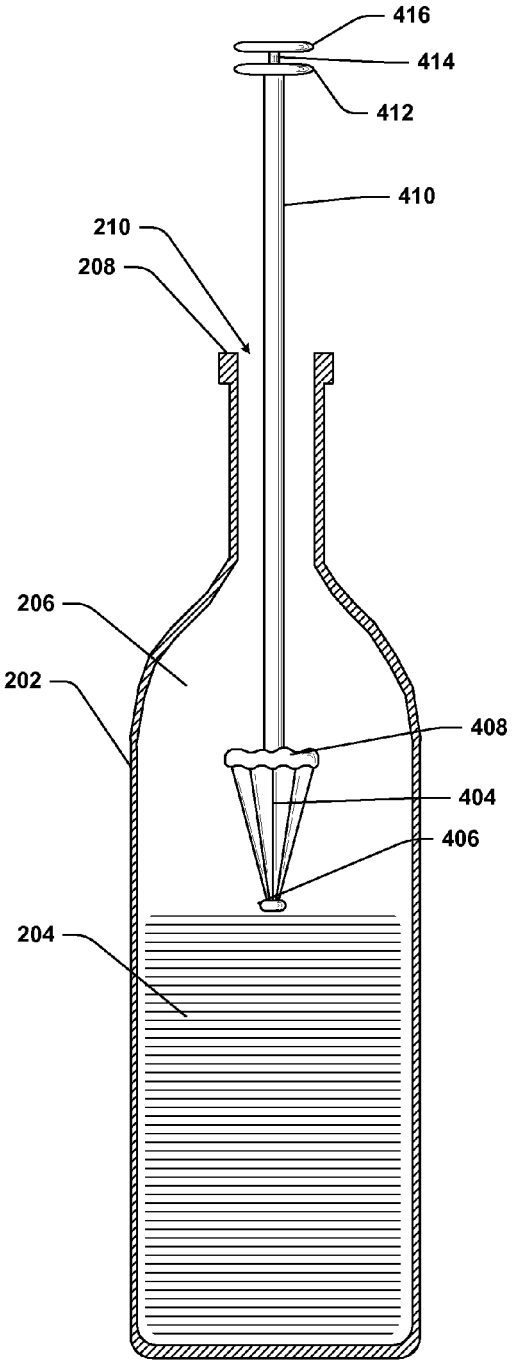
FIGS. 4C-4D show the embodiment of the fluid preservation system in FIGS. 4A-4B in use in a wine bottle.
Figure 4D:
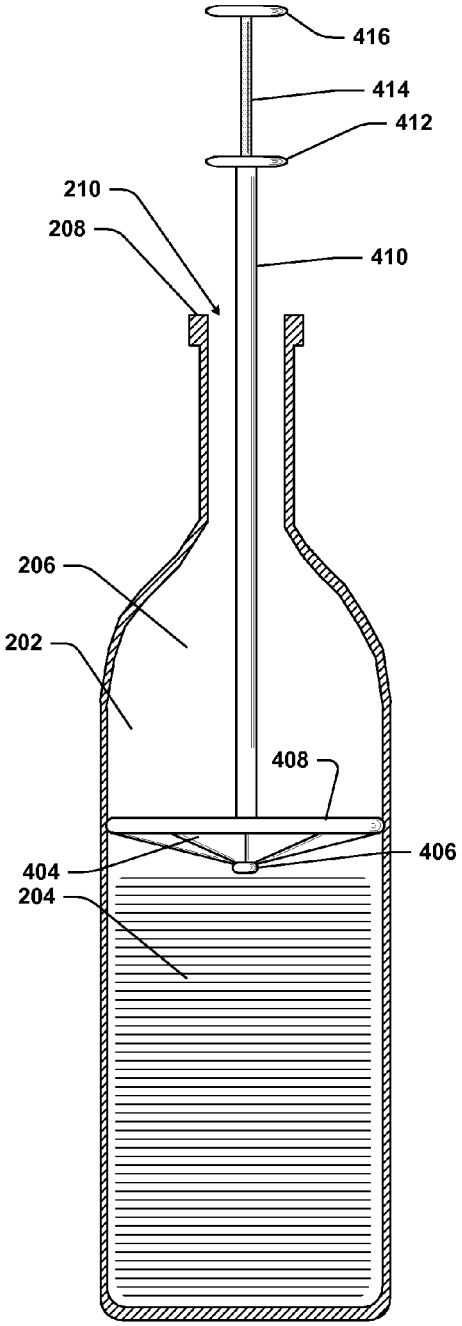

FIG. 4C shows this embodiment of a fluid preservation system in use in a wine bottle. The fluid preservation system is inserted through bottle opening 210 and into the bottle while the expandable sealing member is in the retracted or collapsed state. After the fluid preservation system is in the bottle, the expandable sealing member is expanded (as shown in FIG. 4D) so that the expandable sealing member is larger and sealing edge 408 is pressing up against the interior of the wine bottle at or near the surface of the unconsumed wine. Sealing edge 408 forms a seal against the interior of the wine bottle together with the other components of the expandable sealing member form an air impenetrable barrier. The wine can now be stored without excessive contamination to the wine by the air.

Figure 4E:
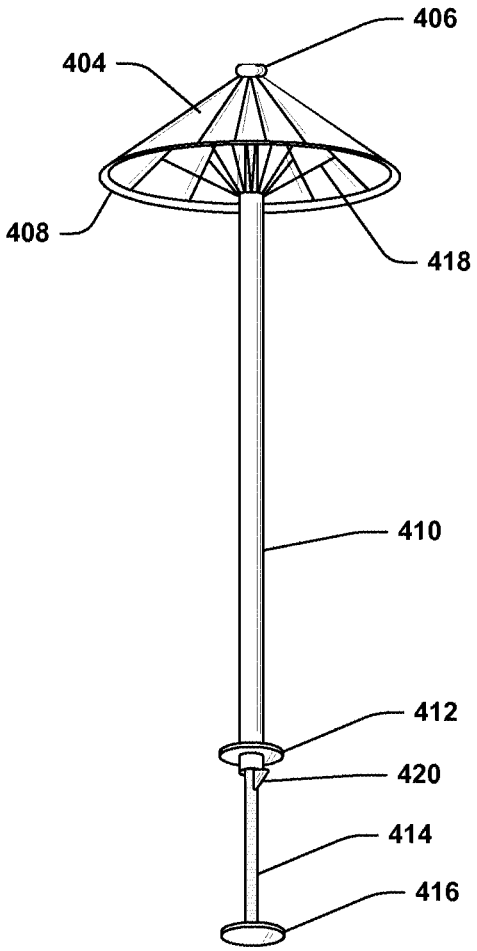
FIG. 4E shows more detail of the embodiment of the fluid preservation system shown in FIGS. 4A-4D.

FIG. 4E shows this embodiment of a fluid preservation system in a slightly different perspective so that the underlying structure 418 may be seen. Locking mechanism 420 functions similarly to that of an umbrella. Multiple locking mechanisms may be present to form a ratchet so that the expandable sealing member may be expanded to contact the inner surface of containers with different diameters.

Figure 5A:
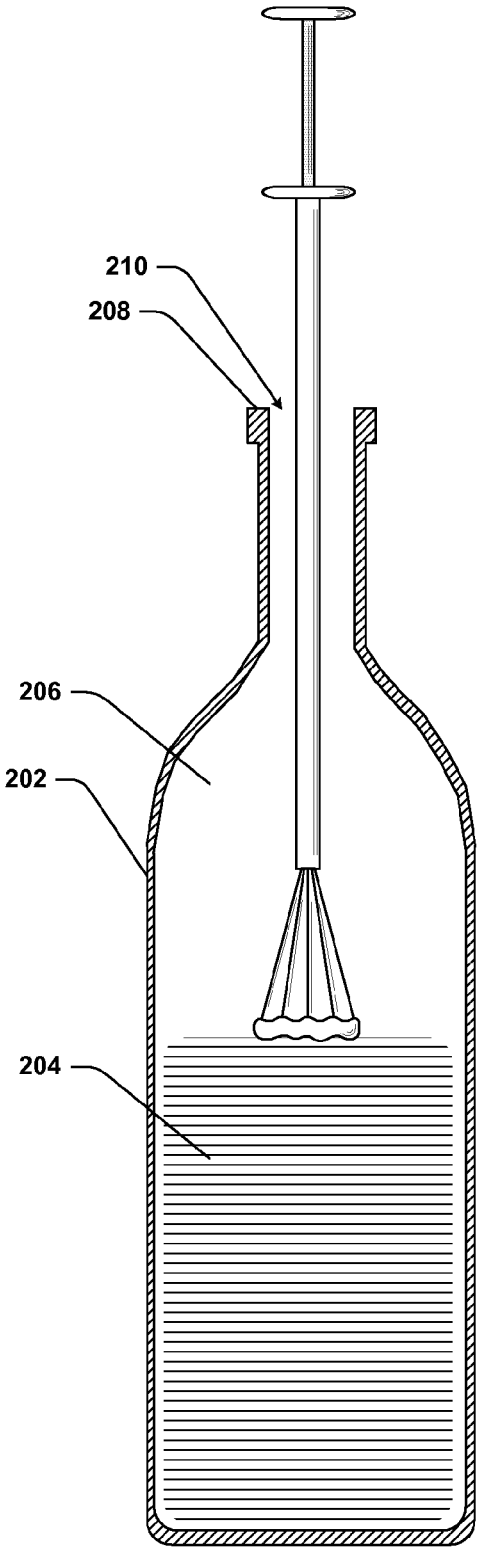
FIGS. 5A-5B show another embodiment of the fluid preservation system in use in a wine bottle.
Figure 5B:
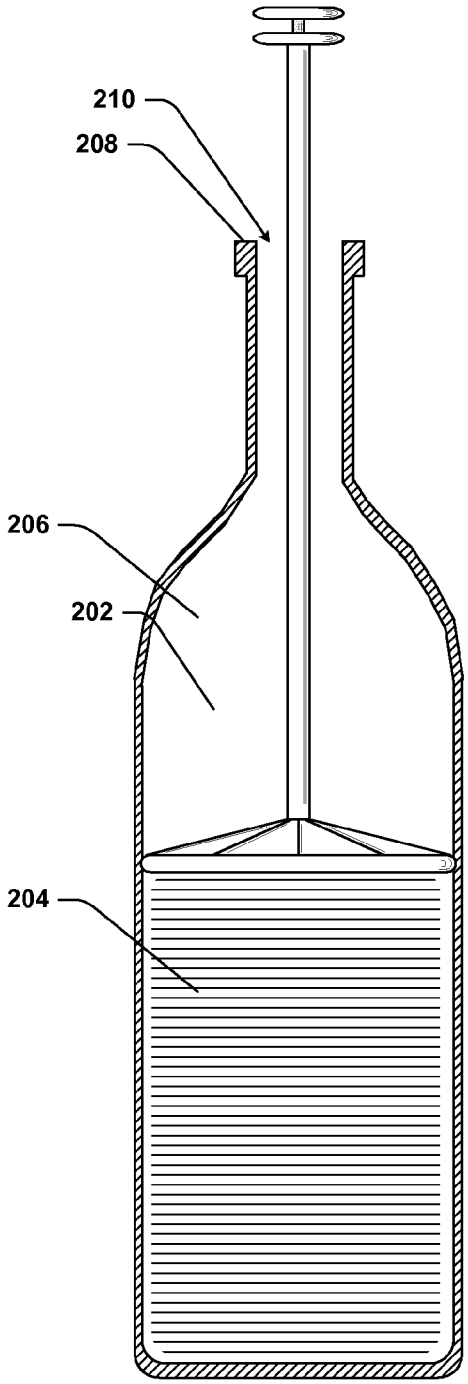

FIGS. 5A and 5B show another embodiment of a fluid preservation system in use in a wine bottle. This embodiment is similar to that shown in FIGS. 4A-D except that the expandable sealing member is inversed.

Figure 6A:
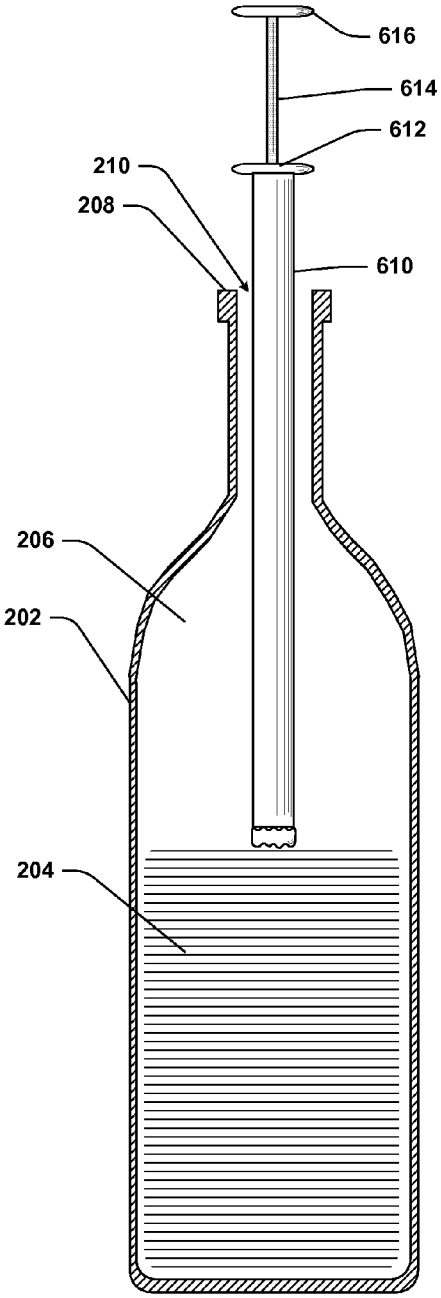
FIGS. 6A-6E show another embodiment of the fluid preservation system in use in a wine bottle, including variations of the embodiment.
Figure 6B:
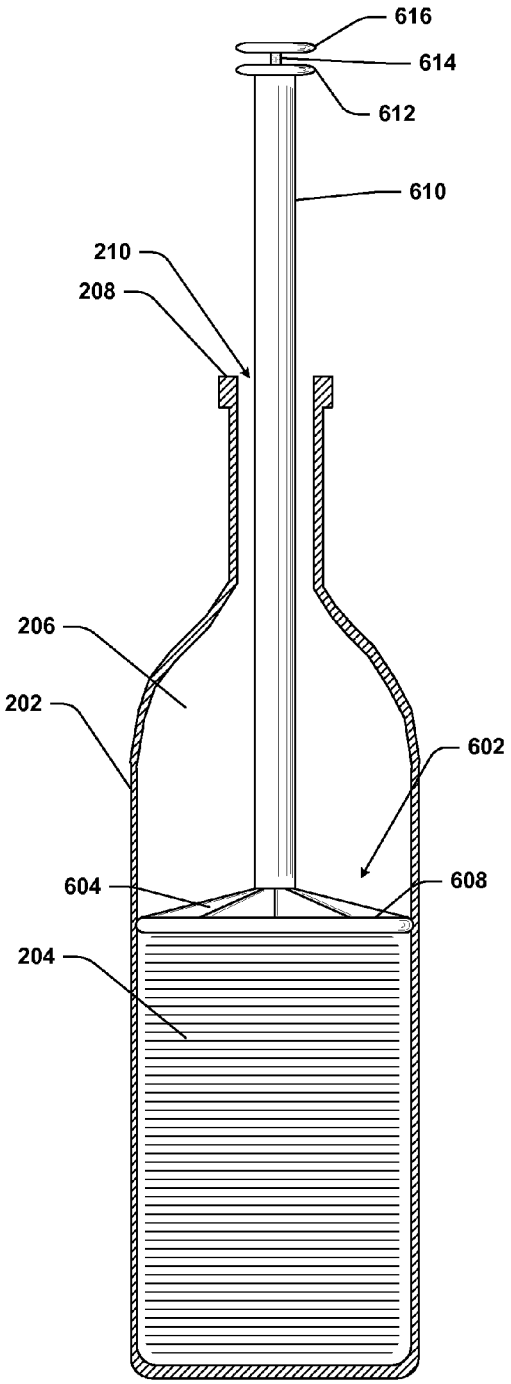

FIGS. 6A and 6B show yet another embodiment of a fluid preservation system with an elongated member and an expandable sealing member in use in a wine bottle. In this embodiment, expandable sealing member 602 is naturally in an expanded state. To collapse the expandable sealing member, the expandable sealing member is drawn inside of outer shaft 610. Flexible sheath 604 is attached to a framework which is naturally in the expanded state. The framework is preferably made out of a relatively rigid material such as metal, plastic or any other suitable material. The framework may be made out of a shape memory metal such as nitinol or a shape memory polymer.

The expandable sealing member is attached to inner shaft 614 and is drawn into outer shaft 610 to collapse it. The outer shaft is preferably hollow and may be made from metal, plastic, or any other suitable material. The material of the outer shaft is preferably relatively inert so that it will not contaminate the fluid if it comes in contact with the fluid. The outer shaft is preferably rigid or semi-rigid.

Inner shaft 614 may be hollow or solid and may be made from metal, plastic, or any other suitable material. The inner shaft is preferably rigid or semi-rigid. The outer diameter of inner shaft 614 is smaller than the inner diameter of outer shaft 610 so that the inner shaft fits inside the outer shaft. Preferably, there is enough space between the inner shaft and the outer shaft so that they can move relative to each other. Outer handle 612 and inner handle 616 serve as grips so that the inner shaft and the outer shaft can be moved relative to each other.

After the fluid preservation system is in the bottle, the system is expanded (as shown in FIG. 6B) so that expandable sealing member is larger and sealing edge 608 is pressing up against the interior of the wine bottle at or near the surface of the unconsumed wine. Sealing edge 608 forms a seal against the interior of the wine bottle together with the other components of the expandable sealing member form an air impenetrable barrier. The wine can now be stored without excessive contamination to the wine by the air. Sealing edge 608 may be made of an elastomeric material so that it can accommodate different diameter bottles, depending on how far outer shaft 610 is moved relative to inner shaft 614. The fluid preservation system may or may not need to be locked in this position for storage.

To remove the fluid preservation system, inner handle 616 is pulled relative to outer handle 612. Doing so draws expandable sealing member 602 into the outer tube which makes it small enough to remove from the bottle. The inner shaft and outer shaft may be moved with respect to each other manually, or with an automatic mechanism. The mechanism may be ratcheted to accommodate different sized containers. The expandable sealing member may be locked in this position. The locking mechanism (not shown) may have a release mechanism, which may be a quick-release mechanism for removing the fluid preservation system from the container.

Figure 6C:
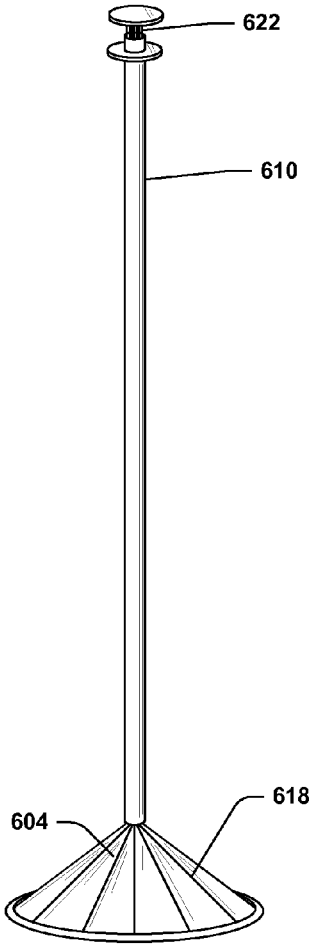
Figure 6D:
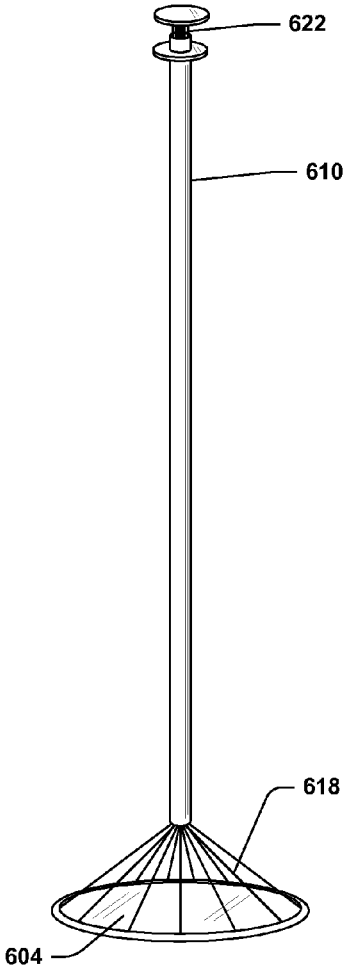
Figure 6E:
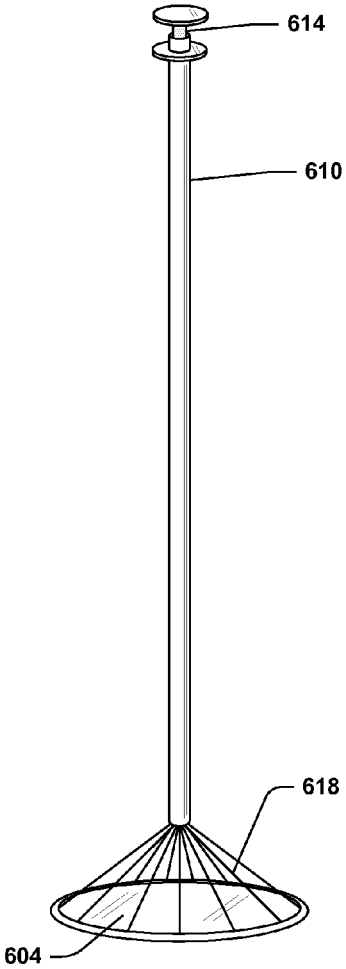

FIGS. 6C, 6D and 6E show some possible variations of the embodiment shown in FIGS. 6A and 6B. Note that flexible sheath 604 is covering framework 618 in FIG. 6C and that flexible sheath 604 is below framework 618 in FIG. 6D. The flexible sheath may be in both positions also. FIG. 6E shows a variation of the embodiment where filaments 622 are enclosed and/or connected to inner tube 614 so that the filaments, which are connected to the framework, can slide more easily through outer tube 610. The existence of the inner tube may also help manufacturability and assembly of the device.

Figure 8A:
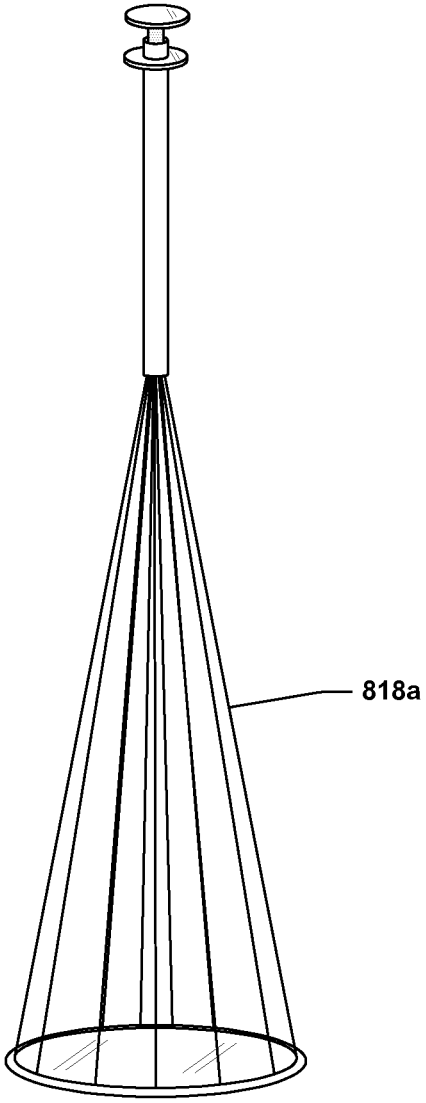
FIGS. 8A-8D show another embodiment of the fluid preservation system, including variations of the embodiment.
Figure 8B:
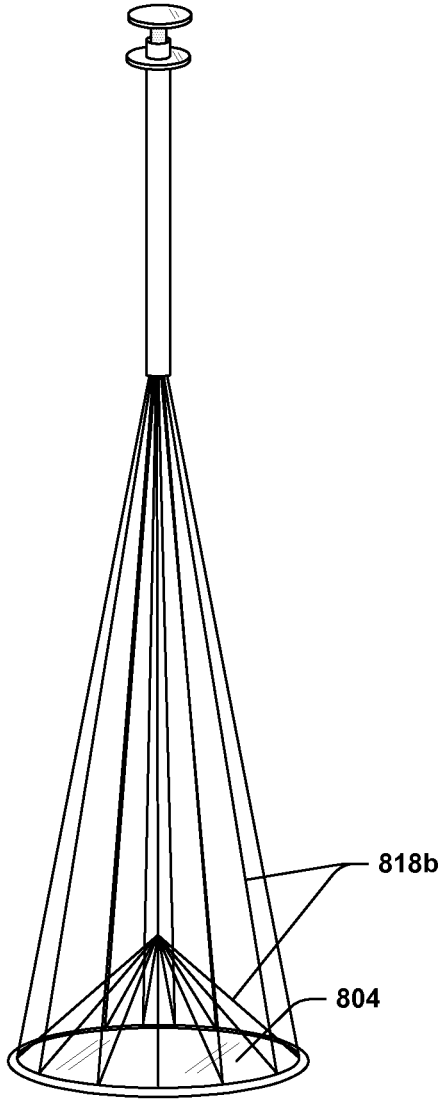
Figure 8C:
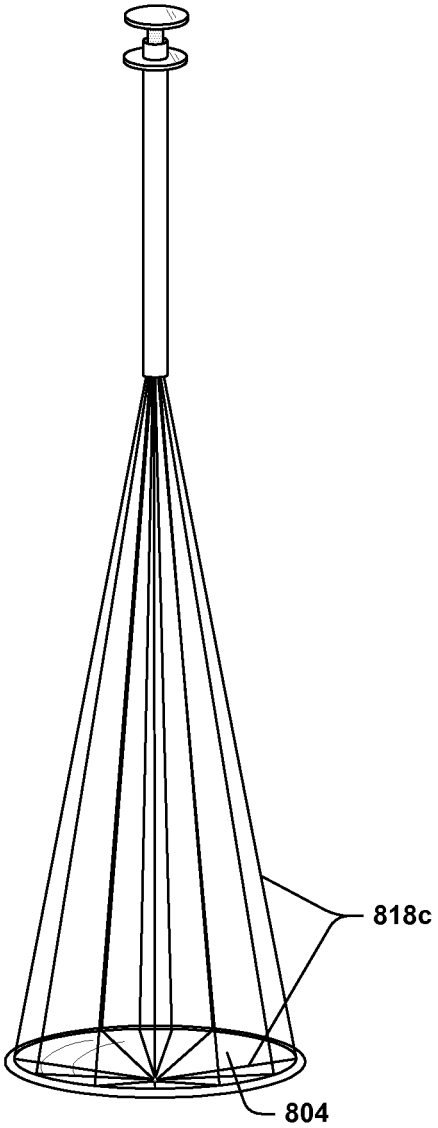
Figure 8D:
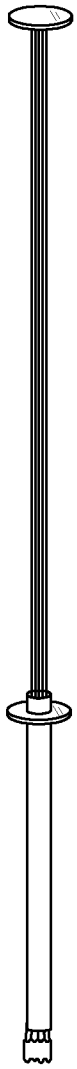

FIGS. 8A, 8B and 8C show three variations of another embodiment of the fluid preservation system with an elongated member and an expandable sealing member. In FIG. 8A framework 818*a* is similar to that of the embodiment shown in FIGS. 6A-E except that the framework is longer. The longer length may reduce the forces necessary to retract the framework into the outer shaft. FIG. 8B has framework 818*b* which comprises both an outer and inner structure. The inner structure of the framework may help flexible sheath 804 expand tightly against the inside edges of the container. FIG. 8C shows yet another variation of the embodiment where framework 818*c* includes the outer structure, and the inner structure, which is pressed against flexible sheath 804. FIG. 8D shows any of the variations of this embodiment of the fluid preservation system when the expandable sealing member is compressed and ready to be inserted or removed from the container.

Figure 9A:
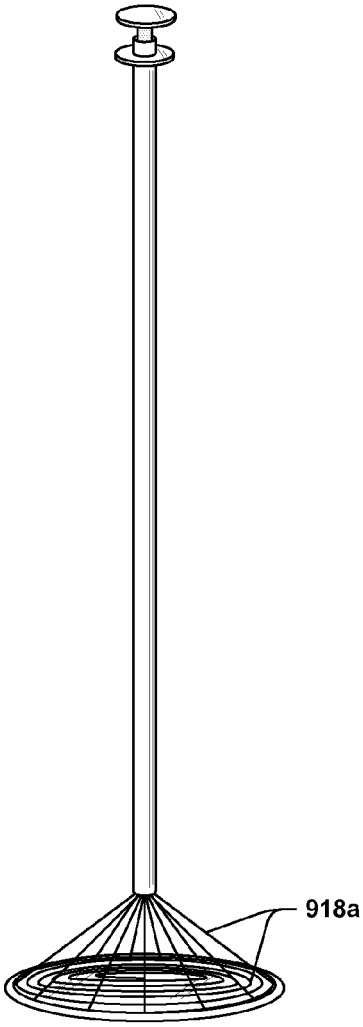
FIGS. 9A-9C show another embodiment of the fluid preservation system, including variations of the embodiment.
Figure 9B:
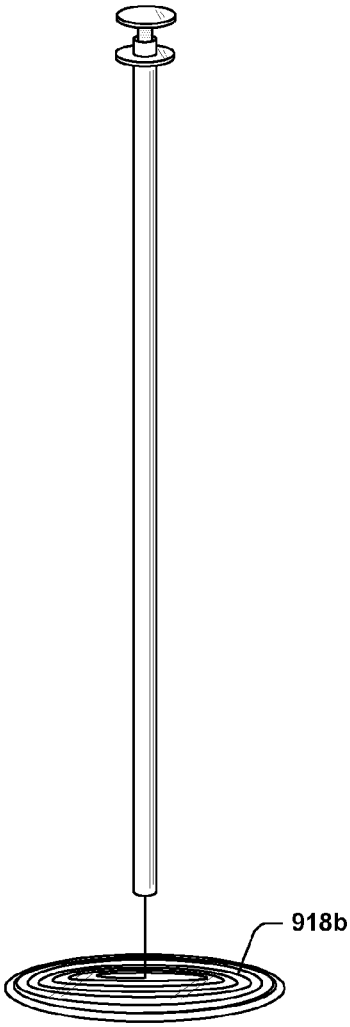
Figure 9C:
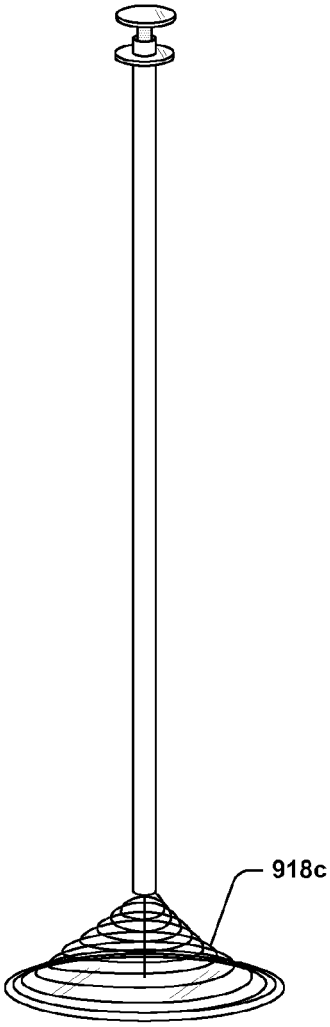

FIGS. 9A, 9B and 9C show three variations of yet another embodiment of the fluid preservation system with an elongated member and an expandable sealing member. Framework 918*a* in FIG. 9A includes both an outer structure and a coiled structure. Framework 918*b* in FIG. 9B includes a flat coiled structure and Framework 918*c* in FIG. 9C includes an elongated coil structure.

Figure 10A:
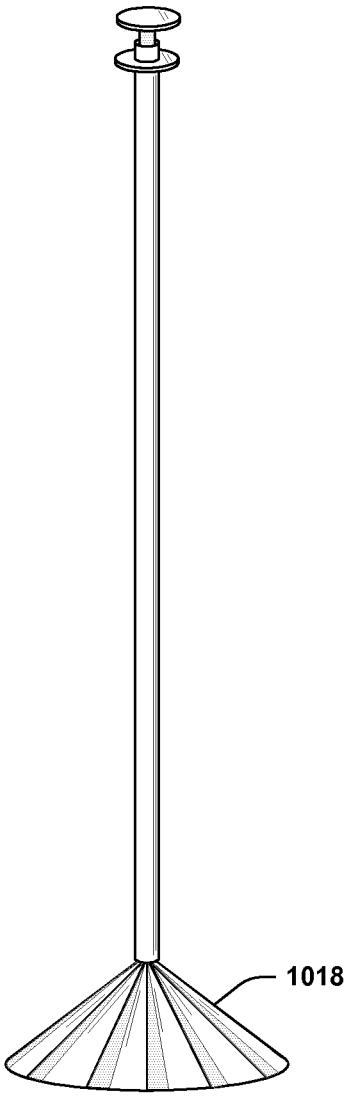
FIGS. 10A-10B show another embodiment of the fluid preservation system.
Figure 10B:
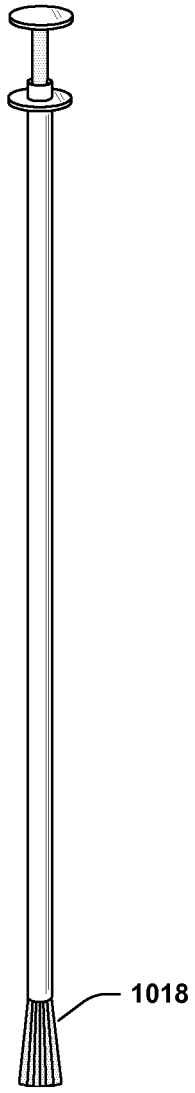

FIGS. 10A and 10B show yet another embodiment of the fluid preservation system with an elongated member and an expandable sealing member. This embodiment includes overlapping sheaths 1018 which can be collapsed. FIG. 10A shows the overlapping sheaths in the expanded position and FIG. 10B shows the overlapping sheaths in the collapsed position. This embodiment may or may not include a flexible sheath at the bottom of the overlapping sheaths.

Figure 11A:
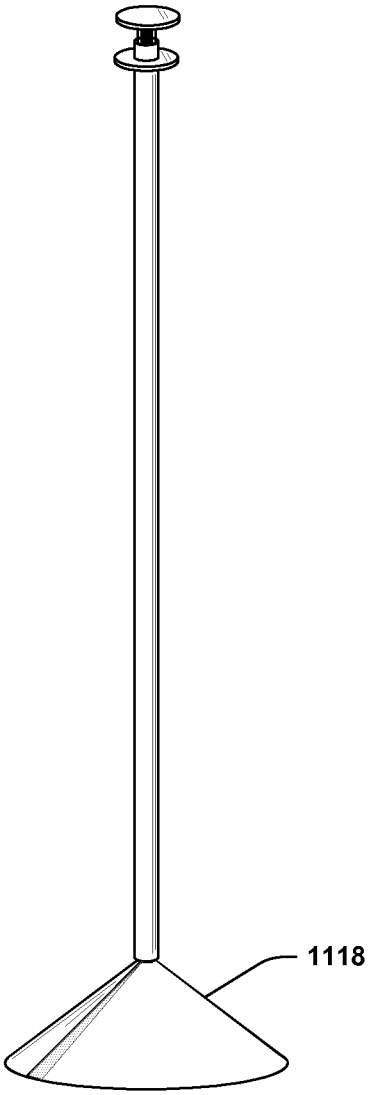
FIGS. 11A-11B show another embodiment of the fluid preservation system.
Figure 11B:
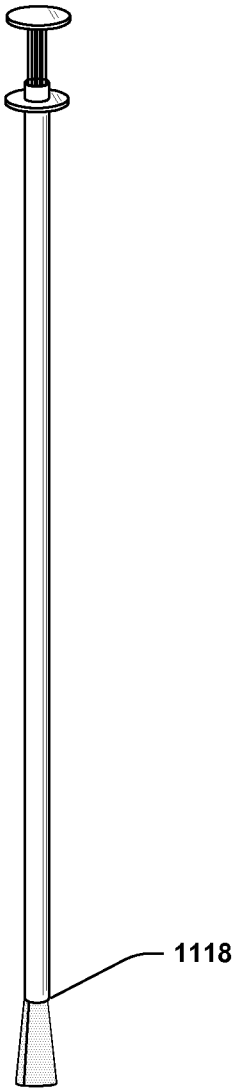

FIGS. 11A and 11B show yet another embodiment of the fluid preservation system with an elongated member and an expandable sealing member. This embodiment includes a singular overlapping sheath 1118 which can be collapsed. FIG. 11A shows the overlapping sheath in the expanded position and FIG. 11B shows the overlapping sheath in the collapsed position. This embodiment may or may not include a flexible sheath at the bottom of the overlapping sheath.

Figure 12A:
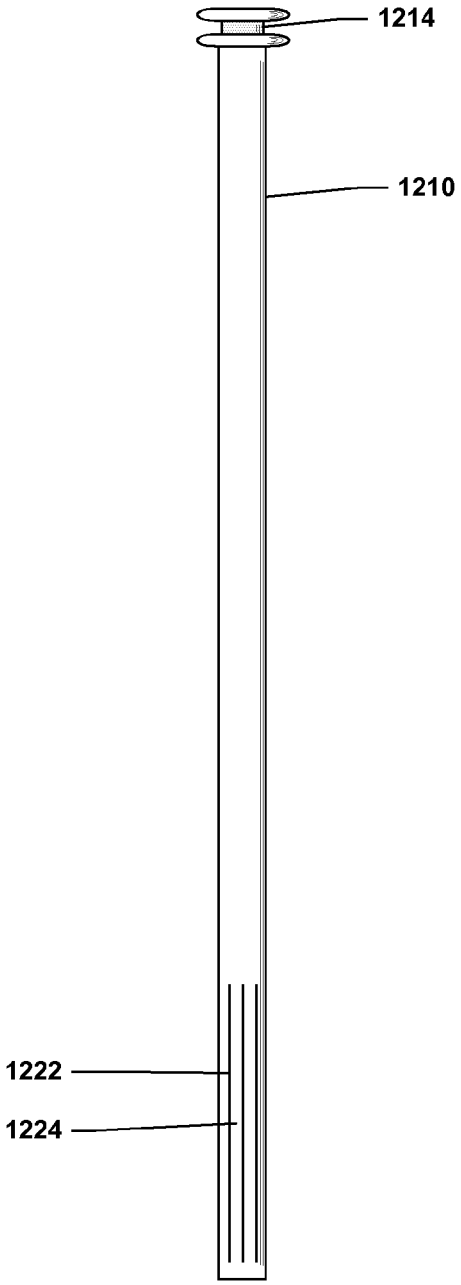
FIGS. 12A-12B show another embodiment of the fluid preservation system.
Figure 12B:
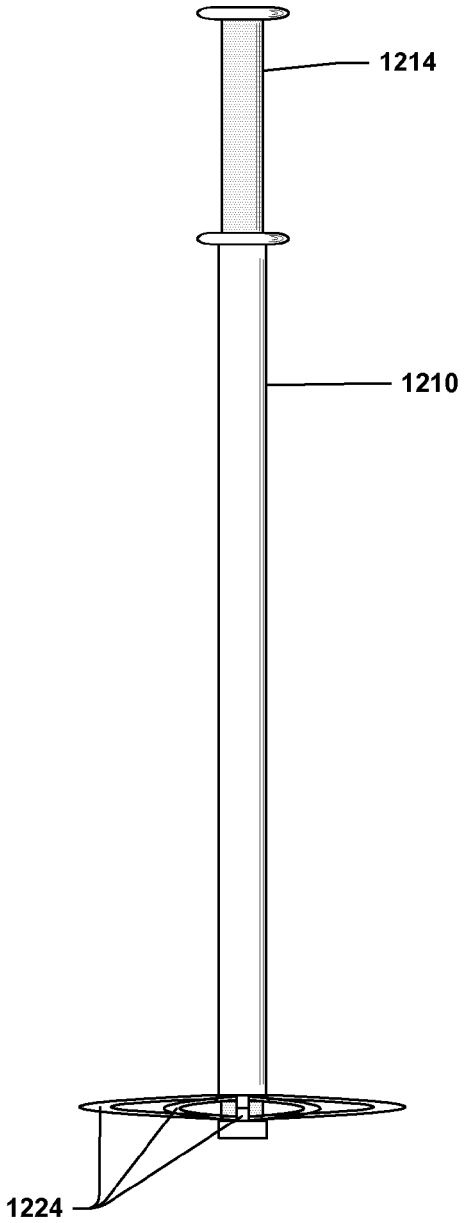

FIGS. 12A and 12B show yet another embodiment of the fluid preservation system with an elongated member and an expandable sealing member. In this embodiment, slits or cuts 1222 are made in outer shaft 1210 to form flexible braces 1224. These flexible brace or braces create the expandable sealing member. When outer shaft 1210 slides along inner shaft 1214, flexible braces 1224 are expanded as shown in FIG. 12B. A flexible sheath may be wrapped around the flexible braces to help seal the container.

Figure 7A:
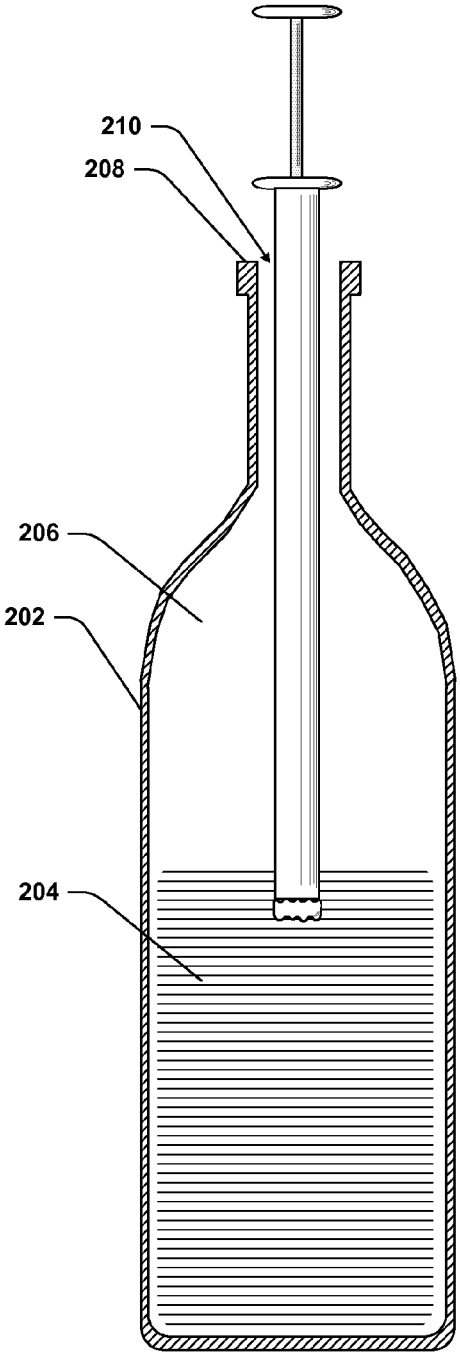
FIGS. 7A-7B show another embodiment of the fluid preservation system in use in a wine bottle.
Figure 7B:
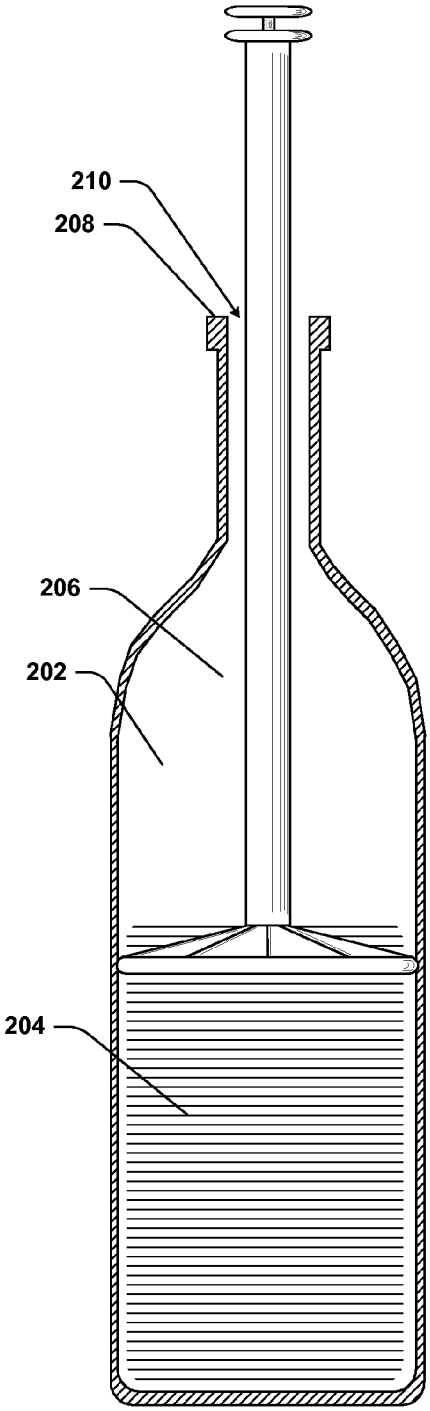

Although these fluid preservation system embodiments have been shown deployed, or expanded, above or at the fluid level of the container, they can also be expanded under the surface of the fluid. Deploying the fluid preservation system in this manner will assure that the fluid is exposed to no contaminating air or gas during storage. The excess fluid above the expansion mechanism of the fluid preservation system may be poured off after the system is deployed, either before or after storage of the fluid. This will prevent the contaminated fluid above the expansion mechanism from mixing with the uncontaminated fluid below the expansion mechanism. This use is depicted in FIGS. 7A-B.

The fluid preservation system may be reusable or disposable.

Any of the embodiments may incorporate features of other embodiments. For example, any of the embodiments may have a locking mechanism that locks the expandable sealing member in place, any of the embodiments may have a ratchet mechanism or be automated. The materials mentioned in any of the embodiments may be used in other embodiments.

It is understood that although the fluid preservation system has been shown in use with a wine bottle, the fluid preservation system could be used in conjunction with any fluid in any container.

What is claimed is:

1. A fluid preservation device for preserving a liquid within a container, the fluid preservation device comprising:

an elongated member with a proximal end and a distal end;

where the elongated member comprises an inner shaft and an outer shaft;

where the outer shaft of the elongated member is attached to the inner shaft of the elongated member;

an expandable sealing member;

where the expandable sealing member is comprised of flexible braces formed by slits in the outer shaft of the elongated member;

where the expandable sealing member has an expanded state and a collapsed state;

a state change mechanism to change the expandable sealing member between the expanded state and the collapsed state;

where the state change mechanism is attached to the inner shaft and the outer shaft of the elongated member near the proximal end of the elongated member;

where the expandable sealing member in the collapsed state is sized to pass through an opening of a container;

and where the expandable sealing member in the expanded state is sized to contact an inner surface of the container near a surface of the liquid.

2. The fluid preservation device of claim 1 where the outer shaft of the elongated member is attached to the inner shaft of the elongated member near the distal end of the elongated member.

3. The fluid preservation device of claim 2 where the expandable sealing member is located near the distal end of the elongated member.

4. The fluid preservation device of claim 1 where the elongated member is made of a rigid material.

5. The fluid preservation device of claim 1 where the state change mechanism causes the inner shaft and outer shaft to move relative to each other to change the state of the expandable sealing member.

6. A fluid preservation device for preserving a liquid within a container, the fluid preservation device comprising:

an elongated member with a proximal end and a distal end;

where the elongated member comprises an inner shaft and an outer shaft;

where the outer shaft is attached to the inner shaft;

where a portion of the outer shaft comprises braces formed by slits in the outer shaft;

where the braces have an expanded state and a collapsed state;

a state change mechanism attached to the proximal end of the inner shaft and the outer shaft of the elongated member to change the braces between the expanded state and the collapsed state;

where the braces in the collapsed state are sized to pass through an opening of a container;

and where the braces in the expanded state are sized to contact an inner surface of the container near a surface of the liquid.

7. The fluid preservation device of claim 6 where the outer shaft of the elongated member is attached to the inner shaft of the elongated member near the distal end of the elongated member.

8. The fluid preservation device of claim 7 where the braces are located near the distal end of the elongated member.

9. The fluid preservation device of claim 6 where the elongated member is made of a rigid material.

10. The fluid preservation device of claim 6 where the state change mechanism causes the inner shaft and outer shaft to move relative to each other to change the state of the braces.

* * * * *